US012747560B2

(12) United States Patent
Sai et al.

(10) Patent No.: US 12,747,560 B2
(45) Date of Patent: Sep. 29, 2026

(54) ELECTRIC WORKING MACHINE

(71) Applicant: Kubota Corporation, Osaka (JP)

(72) Inventors: Takuma Sai, Sakai (JP); Ikuhiro Uotani, Sakai (JP); Junki Ito, Sakai (JP); Daiki Tamba, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 202 days.

(21) Appl. No.: 18/897,199

(22) Filed: Sep. 26, 2024

(65) Prior Publication Data

US 2025/0019935 A1 Jan. 16, 2025

Related U.S. Application Data

(63) Continuation of application No. PCT/JP2023/008995, filed on Mar. 9, 2023.

(30) Foreign Application Priority Data

Mar. 31, 2022 (JP) ..... 2022-060020

(51) Int. Cl.
*E02F 9/20* (2006.01)
*E02F 9/22* (2006.01)
*E02F 9/26* (2006.01)

(52) U.S. Cl.
CPC ..... *E02F 9/207* (2013.01); *E02F 9/2278* (2013.01); *E02F 9/26* (2013.01)

(58) Field of Classification Search
CPC . E02F 9/207; E02F 9/2278; E02F 9/26; E02F 9/2285; E02F 9/2246;
(Continued)

(56) References Cited

U.S. PATENT DOCUMENTS

2013/0275011 A1* 10/2013 Ota ..... E02F 9/2058 701/50
2020/0318656 A1* 10/2020 Kumeuchi ..... E02F 9/2004
2022/0275601 A1 9/2022 Kunizawa et al.

FOREIGN PATENT DOCUMENTS

JP H09158255 A 6/1997
JP 2016061016 A 4/2016
(Continued)

OTHER PUBLICATIONS

International Search Report in PCT/JP2023/008995, mailed May 9, 2023, 3 pages.

*Primary Examiner* — Lori Wu
(74) *Attorney, Agent, or Firm* — Keating & Bennett, LLP

(57) ABSTRACT

An electric working machine includes an electric motor drivable by electric power from a battery on a machine body, a hydraulic device actuatable by power from the electric motor, a working device actuatable by hydraulic pressure of hydraulic fluid supplied from the hydraulic device, a switch switchable between a first position to permit actuation of the working device and a second position to not permit actuation of the working device, and a fluid temperature detector to detect a temperature of hydraulic fluid. While the electric motor is driven, when the switch is switched to the second position and the temperature of hydraulic fluid is within an allowable temperature range that is neither in a low temperature state nor a high temperature state, a controller is configured or programmed to control a rotation speed of the electric motor to a predetermined first rotation speed corresponding to a stopped state of the electric motor.

17 Claims, 7 Drawing Sheets

(58) Field of Classification Search
CPC ..... B60L 2200/40; B60L 2240/36; B60L 2240/421; B60L 2260/20; B60L 1/003
See application file for complete search history.

(56) References Cited

FOREIGN PATENT DOCUMENTS

| | | | |
|---|---|---|---|
| JP | 2016132967 | A | 7/2016 |
| JP | 2021080707 | A | 5/2021 |

* cited by examiner

ELECTRIC WORKING MACHINE

CROSS REFERENCE TO RELATED APPLICATIONS

This application is a continuation application of International Application No. PCT/JP2023/008995, filed on Mar. 9, 2023, which claims the benefit of priority to Japanese Patent Application No. 2022-060020, filed on Mar. 31, 2022. The entire contents of each of these applications are hereby incorporated herein by reference.

BACKGROUND OF THE INVENTION

1. Field of the Invention

The present invention relates to electric working machines each drivable by power from an electric motor.

2. Description of the Related Art

For example, Japanese Unexamined Patent Application Publication No. 2021-80707 discloses an electric working machine driven by the power of an electric motor. The electric working machine disclosed in Japanese Unexamined Patent Application Publication No. 2021-80707 includes an electric motor driven by electric power output from a battery, a hydraulic pump driven by the electric motor to deliver a hydraulic fluid, a hydraulic device driven by the hydraulic fluid delivered by the hydraulic pump, a working device operated by the hydraulic device, an operation device that operates the hydraulic device, a controller that controls the rotation speed of the electric motor, and the like. When the value of current output from the battery is greater than or equal to a predetermined value, the controller sets the rotation speed of the electric motor according to the operation of the operation device, and when the value of current output from the battery is less than the predetermined value, the controller sets the rotation speed of the electric motor to a predetermined idling rotation speed.

SUMMARY OF THE INVENTION

If the electric motor continues to be rotationally driven when an operator is not operating the electric working machine, electric power is wasted, and the working efficiency of the electric working machine decreases.

Example embodiments of the present invention reduce wasteful electric power consumption in electric working machines and improve the working efficiency.

An electric working machine according to an example embodiment of the present invention includes a machine body. a battery mounted on the machine body, an electric motor to be driven by electric power from the battery, a hydraulic device to be actuated by power from the electric motor, a working device to be actuated by a hydraulic pressure of a hydraulic fluid supplied from the hydraulic device, a controller configured or programmed to control driving of the electric motor, a switch operable to be switched between a first position to permit actuation of the working device and a second position to not permit the actuation of the working device, and a fluid temperature detector to detect a temperature of the hydraulic fluid, wherein the controller is configured or programmed to while the electric motor is being driven, when the switch is switched to the second position and the temperature of the hydraulic fluid is within a predetermined allowable temperature range that is neither in a low temperature state nor a high temperature state, control a rotation speed of the electric motor to a predetermined first rotation speed corresponding to a stopped state of the electric motor, and while the electric motor is being driven, when the switch is switched to the second position and the temperature of the hydraulic fluid is not within the allowable temperature range, control the rotation speed of the electric motor to a predetermined idling rotation speed higher than the first rotation speed and lower than or equal to a lower limit of the rotation speed when the working device performs work.

While the electric motor is being driven, when the switch is switched to the second position, the controller may be configured or programmed to, if the temperature of the hydraulic fluid is lower than the allowable temperature range, control the rotation speed of the electric motor to coincide with a predetermined third rotation speed, and if the temperature of the hydraulic fluid is higher than the allowable temperature range, control the rotation speed of the electric motor to a predetermined second rotation speed higher than the first rotation speed and lower than the third rotation speed.

The electric working machine may include a work detector to be actuated by the hydraulic pressure of the hydraulic fluid so as to detect whether the working device is actuated, and the second rotation speed may be set to a rotation speed such as to cause the hydraulic fluid to have a hydraulic pressure that enables the work detector to detect whether the working device is actuated.

While the electric motor is being driven, when the switch is in the first position and the working device is not actuated for a predetermined time or longer, the controller may be configured or programmed to, if the temperature of the hydraulic fluid is lower than the allowable temperature range, control the rotation speed of the electric motor to coincide with the third rotation speed, and if the temperature of the hydraulic fluid is higher than or equal to a lower limit of the allowable temperature range, control the rotation speed of the electric motor to the second rotation speed.

An electric working machine according to another example embodiment of the present invention includes a machine body, a battery mounted on the machine body, an electric motor to be driven by electric power from the battery, a hydraulic device to be actuated by power from the electric motor, a working device to be actuated by a hydraulic pressure of a hydraulic fluid supplied from the hydraulic device, a controller configured or programmed to control driving of the electric motor, a switch operable to be switched between a first position to permit actuation of the working device and a second position to not permit the actuation of the working device, and a fluid temperature detector to detect a temperature of the hydraulic fluid, wherein when the switch is in the first position and the working device has not been actuated for a predetermined time or longer, the controller is configured or programmed to if the temperature of the hydraulic fluid is lower than a predetermined allowable temperature range, control a rotational speed of the electric motor to coincide with a predetermined third rotational speed higher than a predetermined first rotational speed corresponding to a stopped state of the electric motor and lower than or equal to a lower limit of a rotational speed when the working device performs work, and if the temperature of the hydraulic fluid is higher than or equal to a lower limit of the predetermined allowable temperature range, control the rotational speed of the electric motor to a predetermined second rotational speed higher than the first rotational speed and lower than the third rotational speed.

The electric working machine may include a specifier to be operated to specify the rotation speed of the electric motor, and the controller may be configured or programmed to set, according to the temperature of the hydraulic fluid, the rotation speed of the electric motor specifiable by operation of the specifier.

The electric working machine may include a selector to select either a first mode or a second mode that reduces electric power consumption more than the first mode, and the controller may be configured or programmed to, when the temperature of the hydraulic fluid is within the allowable temperature range, set an upper limit of an specified range for the rotation speed of the electric motor by operation of the specifier when the second mode is selected by the selector to be smaller than the upper limit of the specified range when the first mode is selected by the selector.

The controller may be configured or programmed to, when the temperature of the hydraulic fluid is lower than a predetermined first temperature lower than the allowable temperature range, regardless of whether the first mode or the second mode is selected by the selector, set the upper limit of the specified range for the rotation speed of the electric motor by operation of the specifier to a value smaller than a predetermined maximum rotation speed, and the maximum rotation speed may be an upper limit of the rotation speed specifiable by the specifier when the temperature of the hydraulic fluid is within the allowable temperature range and the first mode is selected.

The controller may be configured or programmed to, when the temperature of the hydraulic fluid is higher than a predetermined second temperature higher than the allowable temperature range, regardless of whether the first mode or the second mode is selected by the selector, set the rotation speed specifiable by the specifier to a third rotation speed.

The electric working machine may include a cooler to cool the hydraulic fluid, and the controller may be configured or programmed to, when the temperature of the hydraulic fluid detected by the fluid temperature detector is higher than the allowable temperature range, drive the cooler to cool the hydraulic fluid, and when the temperature of the hydraulic fluid is lower than or equal to the allowable temperature range, stop the cooler.

The electric working machine may include an inverter to adjust the electric power supplied from the battery to the electric motor, a rotation speed detector to detect the rotation speed of the electric motor, and a work operation interface to operate the actuation of the working device, the switch may include an unload operation interface switchable between a load position to permit the actuation of the working device and an unload position to not permit the actuation of the working device, and the controller may be configured or programmed to control the rotation speed of the electric motor by adjusting the electric power supplied from the inverter to the electric motor, based on the rotation speed of the electric motor detected by the rotation speed detector.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

DETAILED DESCRIPTION OF THE EXAMPLE EMBODIMENTS

Figure 1:
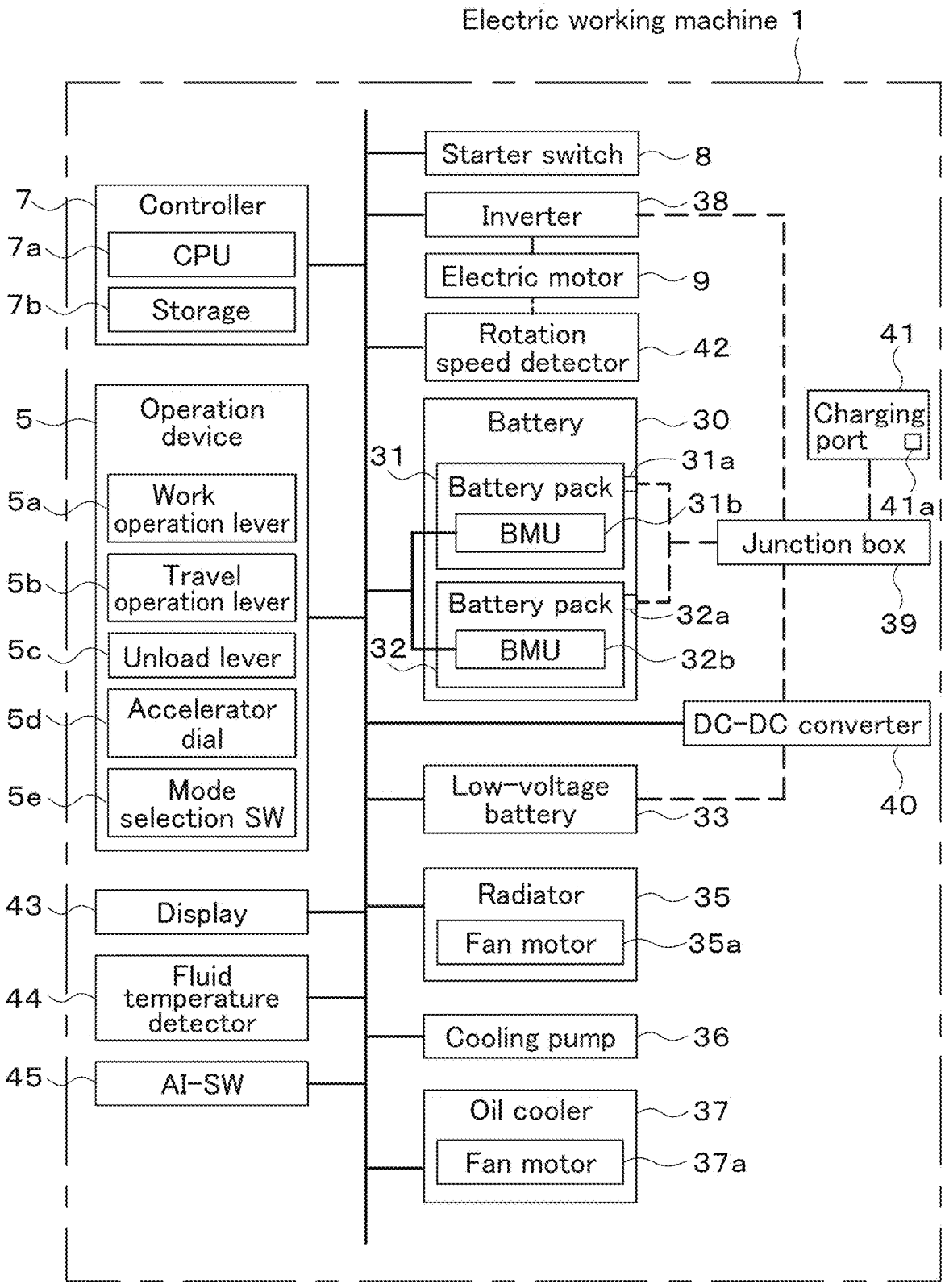
FIG. 1 is an electrical block diagram of an electric working machine.

Example embodiments will now be described with reference to the accompanying drawings, wherein like reference numerals designate corresponding or identical elements throughout the various drawings. The drawings are to be viewed in an orientation in which the reference numerals are viewed correctly.

Hereinafter, example embodiments of the present invention will be described with reference to the drawings.

Figure 5:
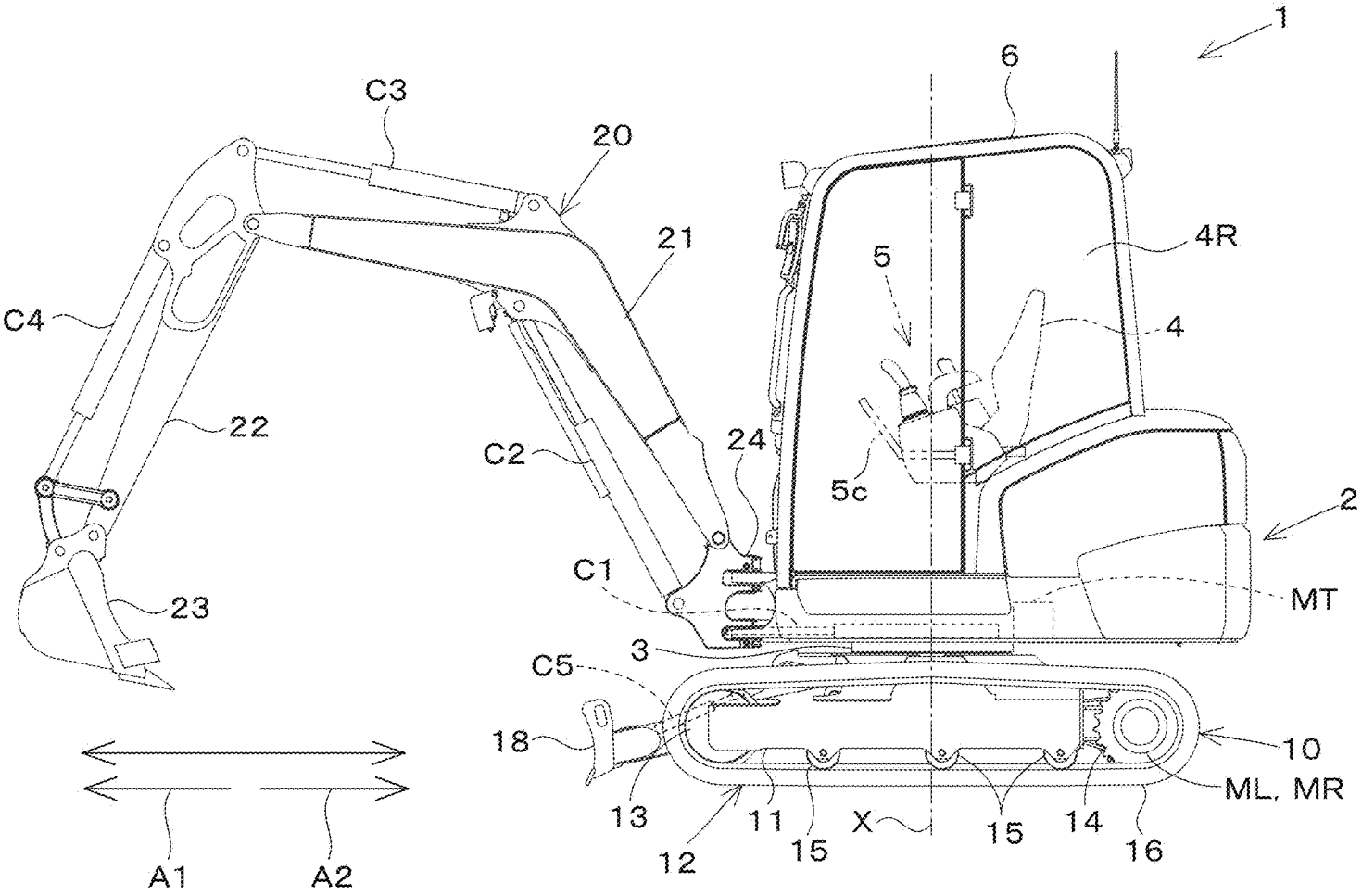
FIG. 5 is an overall side view of the electric working machine.

First, an overall configuration of an electric working machine 1 of the present example embodiment will be described. FIG. 5 is an overall side view of the electric working machine 1. The electric working machine 1 is an excavator called a backhoe, for example. The electric working machine 1 includes a machine body (swivel base) 2, a traveling device 10, a working device 20, and the like. The electric working machine 1 also includes an electric motor 9 (FIG. 1) as a prime mover and is operated by the power of the electric motor 9.

On top of the machine body 2 of the electric working machine 1, there are provided an operator's seat 4 to be seated by an operator (worker) and a protection mechanism 6 that protects the operator's seat 4 from the front, rear, left, right, and above. The protection mechanism 6 is called a cabin. Each side of the protection mechanism 6 is provided with a transparent portion (a so-called window) through which the surroundings can be viewed from the operator's seat 4. The protection mechanism 6 separates the interior space in which the operator's seat 4 is provided from the outside.

Around the operator's seat 4 inside the protection mechanism 6, there is provided an operation device 5 to operate the electric working machine 1. The operator can operate the operation device 5 while seated on the operator's seat 4. In the present example embodiment, the direction toward the working device 20 (arrow A1 direction in FIG. 5) from the protection mechanism 6 is described as the front, and the opposite direction thereof (arrow A2 direction in FIG. 5) is described as the rear. In addition, a horizontal direction perpendicular to the front-rear direction is described as a width direction. Furthermore, when facing the front A1, the left is described as the left, and the right as the right.

The traveling device 10 supports the machine body 2 in a travelable manner. The traveling device 10 includes a traveling frame (track frame) 11 and at least one traveling mechanism 12. The traveling frame 11 is a structure around which the traveling mechanism 12 is attached and above which the machine body 2 is supported. The traveling mechanism 12 is, for example, a crawler type traveling mechanism. The traveling mechanism 12 is provided on each of the left and right of the traveling frame 11. The traveling mechanism 12 includes an idler 13, a driving wheel 14, a plurality of rollers 15, an endless crawler belt 16, and traveling motors ML and MR.

The idler 13 is disposed at the front of the traveling frame 11. The driving wheel 14 is disposed at the rear of the traveling frame 11. The plurality of rollers 15 are provided between the idler 13 and the driving wheel 14. The crawler belt 16 is wound around the idler 13, the driving wheel 14, and the rollers 15.

The left traveling motor ML is included in the traveling mechanism 12 located on the left of the traveling frame 11. The right traveling motor MR is included in the traveling mechanism 12 located on the right of the traveling frame 11. These traveling motors ML and MR are hydraulic motors, for example. In each of traveling mechanisms 12, the driving wheel 14 is rotationally driven by the power of the traveling motor ML or MR, causing the crawler belt 16 to circulate in the circumferential direction.

A dozer device 18 is attached to the front of the traveling device 10. The dozer device 18 swings up and down by the extension and contraction of a dozer cylinder C5. The dozer cylinder C5 is attached to the traveling frame 11. The dozer cylinder C5 is a hydraulic cylinder, for example.

The machine body 2 is supported on the traveling frame 11 via a swivel bearing 3 so as to be rotatable around a swivel axis X. A swivel motor MT is provided inside the machine body 2. The swivel motor MT is a hydraulic motor (a hydraulic actuator included in hydraulic devices), for example. The machine body 2 swivels around the swivel axis X by the power of the swivel motor MT.

The working device 20 is supported at the front of the machine body 2. The working device 20 includes a boom 21, an arm 22, a bucket (working tool) 23, and hydraulic cylinders C1 to C5. The base end of the boom 21 is pivotally mounted to a swing bracket 24 so as to be rotatable around a horizontal axis (an axis extending in the width direction of the machine body 2). Therefore, the boom 21 is capable of swinging up and down (vertically). The arm 22 is pivotally mounted on the distal end of the boom 21 so as to be rotatable around a horizontal axis. Therefore, the arm 22 is capable of swinging in the front-rear or up-down direction. The bucket 23 is provided at the distal end of the arm 22 so as to be capable of a shovel operation and dump operation.

Instead of the bucket 23 or in addition to the bucket 23, another working tool (hydraulic attachment) that can be driven by a hydraulic actuator can be attached to the distal end of the arm 22. Examples of the other working tool include a hydraulic breaker, a hydraulic crusher, an angle broom, an earth auger, a pallet fork, a sweeper, a mower, a snow blower, and the like.

The swing bracket 24 swings left and right by the extension and contraction of the swing cylinder C1 provided inside the machine body 2. The boom 21 swings up and down (back and forth) by the extension and contraction of the boom cylinder C2. The arm 22 swings up and down (back and forth) by the extension and contraction of the arm cylinder C3. The bucket 23 performs a shovel operation and dump operation by the extension and contraction of the bucket cylinder (working tool cylinder) C4. The swing cylinder C1, the boom cylinder C2, the arm cylinder C3, and the bucket cylinder C4 are hydraulic cylinders, for example.

The electric working machine 1 performs work, such as excavation, by driving the traveling device 10 with the traveling motors ML and MR, driving the working device 20 with the hydraulic cylinders C1 to C5, and swiveling the machine body 2 with the swivel motor MT. Hydraulic actuators, such as the traveling motors ML and MR, the swivel motor MT, and the hydraulic cylinders C1 to C5, are included in hydraulic devices. Not only the working device 20 but also the traveling device 10 is a working device provided on the electric working machine 1. Hereinafter, for convenience, the working device 20 and the traveling device 10 will be collectively referred to as "working devices 20 and 10."

Next, an electrical configuration of the electric working machine 1 will be described. FIG. 1 is an electrical block diagram of the electric working machine 1. In FIG. 1, a controller 7 includes a CPU 7*a* and a storage 7*b*. The CPU 7*a* controls the operation of each unit of the electric working machine 1 illustrated in FIG. 1. The storage 7*b* may include a volatile memory, a nonvolatile memory, and the like, for example. Information, data, programs, and the like used by the CPU 7*a* to control the operation of each unit are stored in a readable and writable manner in the storage 7*b*.

The operation device 5 includes operation interfaces such as a work operation lever 5*a*, a travel operation lever 5*b*, an unload lever 5*c*, an accelerator dial 5*d*, and a mode selection SW (switch) 5*e*. The operation device 5 also includes a potentiometer, a switch, a sensor, or the like (not illustrated) to detect whether each of the operation interfaces 5*a* to 5*e* is operated, the operating position thereof, or the operating amount thereof.

The work operation lever 5*a* is capable of operating the actuation of the working device 20. The travel operation lever 5*b* is capable of operating the actuation of the traveling device 10. In FIG. 1, the work operation lever 5*a* and the travel operation lever 5*b* are each illustrated as one block for convenience. However, a plurality of work operation levers 5*a* and a plurality of travel operation levers 5*b* are actually provided. The work operation lever 5*a* and the travel operation lever 5*b* are examples of the "work operation interface".

The unload lever 5*c* can be switched between a load position (first position) to permit the actuation of the working device 20 and an unload position (second position) to not permit (prohibiting) the actuation of the working device 20. The unload lever 5*c* is disposed, for example, at a side of the operator's seat 4 (FIG. 5) so as to be capable of swinging up and down.

By the unload lever 5*c* swinging down to be in the load position (first position, lowered position), the passage for the operator to get on and off an operator's room 4R is closed. By the unload lever 5*c* swinging up to be in the unload position (second position, raised position), the passage is opened. The unload lever 5*c* is an example of the "unload operation interface". The unload lever 5*c* is also an example of a configuration included in the "switch".

The accelerator dial 5*d* is rotated to specify the rotation speed of the electric motor 9. The angle range in which the accelerator dial 5*d* can be rotated corresponds to a specification range in which the rotation speed of the electric motor 9 can be specified. Therefore, by changing the operating position of the accelerator dial 5*d*, a specified value for the rotation speed of the electric motor 9 can also be changed. Specifically, the controller 7 calculates the specified value for the rotation speed of the electric motor 9 according to the operation state of the accelerator dial 5*d* (whether it is operated and the operating position). The accelerator dial 5*d* is an example of the "specifier".

The mode selection SW 5*e* is a switch that is operated to select either a normal mode (first mode) to control the driving of the electric motor 9, or an ECO mode (ecology mode, second mode) to reduce electric power consumption more than the normal mode. The mode selection SW 5*e* is an example of the "selector".

Inside the protection mechanism 6, there is provided a starter SW (switch) 8, which can be operated by the operator seated on the operator's seat 4. The starter SW 8 is operated to start and stop the electric working machine 1. Specifically, when the starter SW 8 is turned on, the controller 7 starts each unit of the electric working machine 1. In addition, when the starter SW 8 is turned off, the controller 7 stops each unit of the electric working machine 1.

The electric motor 9 is a drive source (one example of a prime mover) of the electric working machine 1 and may be, for example, a permanent magnet embedded type three-phase AC synchronous motor. An inverter 38 is a motor driving device that drives the electric motor 9. The inverter 38 is connected to the electric motor 9 and a junction box 39.

In addition to the inverter 38, the junction box 39 is connected to a battery 30, a DC-DC converter 40, and a charging port 41. The junction box 39 outputs electric power output from the battery 30 to the inverter 38 and the DC-DC converter 40.

The inverter 38 converts DC power input from the battery 30 via the junction box 39 into three-phase AC power and supplies the three-phase AC power to the electric motor 9. As a result, the electric motor 9 is driven. In addition, the inverter 38 can freely adjust the current and voltage of electric power to be supplied to the electric motor 9. The controller 7 controls the operation of the inverter 38 to drive and stop the electric motor 9.

A rotation speed detector 42 may include a sensor that detects the rotation speed (actual rotation speed) of the electric motor 9, an encoder, a pulse generator, or the like, for example. The controller 7 controls, for example, based on the rotation speed (actual rotation speed) of the electric motor 9 detected by the rotation speed detector 42, the driving of the electric motor 9 by the inverter 38. More specifically, the controller 7 controls the driving of the electric motor 9 by the inverter 38 such that the actual rotation speed of the electric motor 9 detected by the rotation speed detector 42 coincides with the target rotation speed (specified value by the accelerator dial 5*d* or one of predetermined rotation speeds R1 to R3 described later).

The DC-DC converter 40 is a voltage converter that converts the voltage of the DC power input from the battery 30 via the junction box 39 into a different voltage. In the present example embodiment, the DC-DC converter 40 is a step-down converter that converts a high voltage of the battery 30 into a predetermined low voltage according to electrical equipment provided in the electric working machine 1. The DC-DC converter 40 supplies electric power to a low-voltage battery 33 after voltage conversion. The electrical equipment provided in the electric working machine 1 includes lighting, a heater, and the like in addition to the units illustrated in FIG. 1.

The charging port 41 includes a connector (not illustrated) into which a charging cable (not illustrated) is fitted and a connection detector 41*a*. The charging port 41 is connected to an external power source (e.g., commercial power source) via the charging cable. The connection detector 41*a* may be, for example, a sensor or the like that detects the connection of the external power source by the charging cable fitted into the charging port 41.

The junction box 39 outputs, to the battery 30, electric power input from the external power source via the charging cable through the charging port 41. The battery 30 is charged with the electric power input from the charging port 41 via the junction box 39.

The battery 30 includes a plurality of battery packs 31 and 32. Each of the battery packs 31 and 32 is a secondary battery (storage battery) such as a lithium ion battery including at least one battery, for example. When each of the battery packs 31 and 32 includes a plurality of batteries, the plurality of batteries are electrically connected in series and/or in parallel. In addition, the batteries of each of the battery packs 31 and 32 may include a plurality of cells therein, and the plurality of cells are electrically connected in series and/or in parallel, for example. Each of the battery packs 31 and 32 has an electric capacity sufficient to operate each unit of the electric working machine 1 for a predetermined time. The battery packs 31 and 32 are connected in parallel.

In the present example embodiment, the battery 30 is provided with the two battery packs 31 and 32. However, the number of battery packs included in the battery 30 is not limited to two and may be one, or three or more.

The battery packs 31 and 32 are provided with connection switches 31*a* and 32*a*, respectively. Each of the connection switches 31*a* and 32*a* may include, for example, a relay, a switch, or the like and can be switched between a connected state and a disconnected state.

The controller 7 outputs electric power from one of the plurality of battery packs 31 and 32 to the junction box 39 and stops the output of electric power from the other battery pack by switching one connection switch of the connection switches 31*a* and 32*a* to the connected state and switching the other connection switch to the disconnected state. That is, the controller 7 controls the output and stop of the electric power of each of the battery packs 31 and 32.

The controller 7 switches the connection state inside the junction box 39 to connect or disconnect the inverter 38, the DC-DC converter 40, or the charging port 41 to each of the battery packs 31 and 32. The junction box 39 and the connection switches 31*a* and 32*a* are connection switches that switch between connection and disconnection of the inverter 38, the DC-DC converter 40, and the charging port 41 to and from each of the battery packs 31 and 32. Each of the battery packs 31 and 32 is further provided with BMUs (battery management units, battery monitors) 31*b* and 32*b*. In FIG. 1, the BMUs 31*b* and 32*b* are provided within the corresponding battery packs 31 and 32. However, the BMUs 31*b* and 32*b* may be built in the corresponding battery packs 31 and 32 or may be disposed outside the battery packs 31 and 32.

The BMU 31*b* monitors and controls the corresponding battery pack 31. The BMU 32*b* monitors and controls the corresponding battery pack 32. Specifically, the BMUs 31*b* and 32*b* control the opening and closing of relays provided inside the battery packs 31 and 32 to control the start and stop of electric power supply from the battery packs 31 and 32. In addition, the BMUs 31*b* and 32*b* detect the temperatures, voltages, currents, internal cell terminal voltages, or the like of the battery packs 31 and 32.

Furthermore, the BMUs 31*b* and 32*b* detect a remaining capacity (remaining electric power amount) of the battery packs 31 and 32 by a voltage measurement method, based on the internal cell terminal voltages of the battery packs 31 and 32, for example. Note that the method of detecting the remaining capacity of the battery packs 31 and 32 is not limited to the voltage measurement method, but may be other methods such as a Coulomb counting method, a battery cell modeling method, an impedance tracking method, and the like. In addition, a capacity detector to detect the remaining capacity of the battery packs 31 and 32 may be provided separately from the BMUs 31*b* and 32*b*.

The low-voltage battery 33 is a storage battery with a lower voltage than the battery 30. The low-voltage battery 33 is charged with electric power supplied from the DC-DC converter 40. The low-voltage battery 33 supplies the electric power to the electrical equipment provided in the electric working machine 1.

A radiator 35 cools cooling water to cool high-heat generating electric devices such as the electric motor 9, the inverter 38, the DC-DC converter 40, and the battery 30. The high-heat generating electric devices are electric devices that generate more heat than other electric devices provided in the electric working machine 1 when operated with electric power. The cooling water is not simply water, but is a liquid that does not freeze even in cold regions.

The radiator 35 includes a fan motor 35*a*, a radiator fan that is rotationally driven by the power of the fan motor 35*a*, and a heat exchanger (not illustrated). The fan motor 35*a* is driven by the electric power of the low-voltage battery 33.

A cooling pump 36 is provided in a cooling water passage (not illustrated) disposed within the machine body 2 together with the radiator 35 and the above high-heat generating electric devices. The cooling pump 36 delivers and circulates the cooling water to and through the cooling water passage.

An oil cooler 37 cools the hydraulic fluid that has passed through hydraulic devices such as the hydraulic actuators ML, MR, MT, and C1 to C5 described above and hydraulic pumps P1 and P2 and a control valve CV (illustrated in FIG. 2 or the like) described below. The oil cooler 37 includes a fan motor 37*a*, an oil cooler fan that is rotationally driven by the power of the fan motor 37*a*, and a heat exchanger (not illustrated). The fan motor 37*a* is driven by the electric power of the low-voltage battery 33. The oil cooler 37 is an example of the "cooler".

A display 43 may include a liquid crystal display, a touch panel, or the like, and displays various kinds of information, for example. A fluid temperature detector 44 may be a sensor that detects the temperature of the hydraulic fluid, for example. Hereinafter, the temperature of the hydraulic fluid will be referred to as "hydraulic fluid temperature."

An AI (auto-idling)-SW (switch) 45 may include a pressure sensor that is actuated by the hydraulic pressure of the hydraulic fluid, for example. The AI-SW 45 is turned on when at least one of the working devices 20 and 10 is actuated, and is turned off when neither of the working devices 20 and 10 is actuated. That is, the AI-SW 45 detects whether the working devices 20 and 10 are actuated. The AI-SW 45 is an example of the "work detector".

Figure 2:
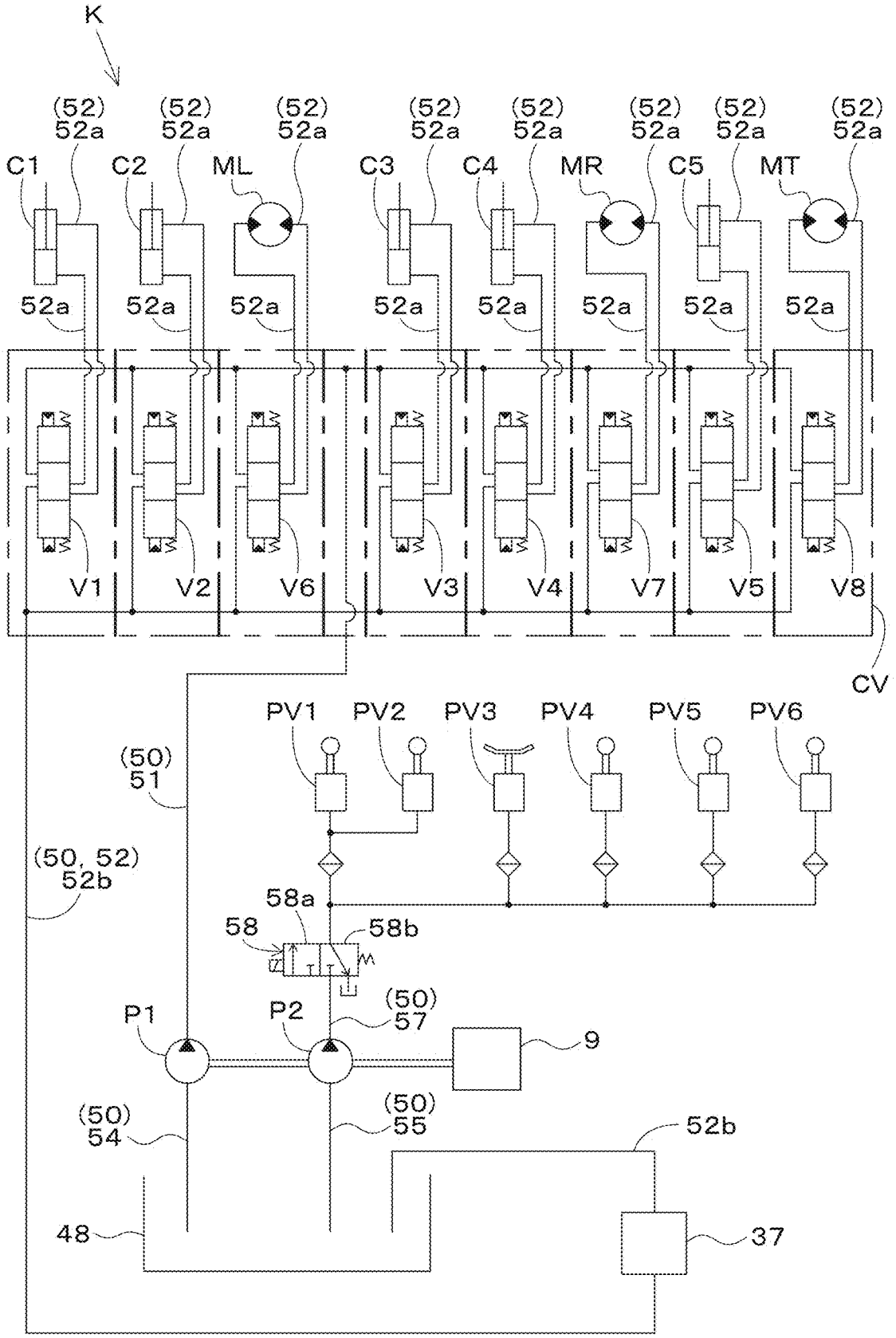
FIG. 2 is a hydraulic circuit diagram of the electric working machine.

Next, a hydraulic circuit provided in the electric working machine 1 will be described. FIG. 2 is a diagram illustrating a hydraulic circuit K provided in the electric working machine 1. The hydraulic circuit K is provided with hydraulic devices such as the hydraulic actuators C1 to C5, ML, MR, and MT, the control valve CV, the hydraulic pumps P1 and P2, a hydraulic fluid tank 48, the oil cooler 37, operation valves PV1 to PV6, an unload valve 58, and a fluid passage 50.

Of the plurality of hydraulic pumps P1 and P2, one is the actuation hydraulic pump P1 and the other is the control hydraulic pump P2. These hydraulic pumps P1 and P2 are driven by the power of the electric motor 9.

The actuation hydraulic pump P1 sucks the hydraulic fluid stored in the hydraulic fluid tank 48 and then delivers the hydraulic fluid to the control valve CV. For convenience, FIG. 2 illustrates the one actuation hydraulic pump P1. However, without limitation, an appropriate number of actuation hydraulic pumps P1 may be provided so as to supply the hydraulic fluid to each of the hydraulic actuators C1 to C5, ML, MR, and MT.

The control hydraulic pump P2 sucks the hydraulic fluid stored in the hydraulic fluid tank 48 and then delivers the hydraulic fluid to output a hydraulic pressure for signals, control, or the like. That is, the control hydraulic pump P2 supplies (delivers) a pilot fluid. An appropriate number of control hydraulic pumps P2 may be provided too.

The control valve CV includes a plurality of control valves V1 to V8. Each of the control valves V1 to V8 adjusts the control (adjustment) of the flow rate of the hydraulic fluid to be output from the hydraulic pumps P1 and P2 to each of the hydraulic actuators C1 to C5, ML, MR, and MT.

Specifically, the swing control valve V1 controls the flow rate of the hydraulic fluid to be supplied to the swing cylinder C1. The boom control valve V2 controls the flow rate of the hydraulic fluid to be supplied to the boom cylinder C2. The arm control valve V3 controls the flow rate of the hydraulic fluid to be supplied to the arm cylinder C3. The bucket control valve V4 controls the flow rate of the hydraulic fluid to be supplied to the bucket cylinder C4. The dozer control valve V5 controls the flow rate of the hydraulic fluid to be supplied to the dozer cylinder C5. The left traveling control valve V6 controls the flow rate of the hydraulic fluid to be supplied to the left traveling motor ML. The right traveling control valve V7 controls the flow rate of the hydraulic fluid to be supplied to the right traveling motor MR. The swivel control valve V8 controls the flow rate of the hydraulic fluid to be supplied to the swivel motor MT.

The operation valves (remote control valves) PV1 to PV6 are actuated in response to the operation of the operation levers 5*a* and 5*b* (FIG. 1) included in the operation device 5. The pilot fluid acts on each of the control valves V1 to V8 in proportion to the actuating amount (operating amount) of each of the operation valves PV1 to PV6, causing a spool of each of the control valves V1 to V8 to move linearly. Then, the hydraulic fluid is supplied to the hydraulic actuators C1 to C5, ML, MR, and MT to be controlled, at a flow rate proportional to the amount of movement of the spool of each of the control valves V1 to V8. Furthermore, the hydraulic actuators C1 to C5, ML, MR, and MT are driven according to the amount of hydraulic fluid supplied from the control valves V1 to V8.

In other words, when the operation levers 5*a* and 5*b* are operated, the hydraulic fluid (pilot fluid) acting on the control valves V1 to V8 is adjusted, and the control valves V1 to V8 are controlled. Then, the flow rate of the hydraulic fluid supplied from the control valves V1 to V8 to the hydraulic actuators C1 to C5, ML, MR, and MT is adjusted, and the driving and stopping of the hydraulic actuators C1 to C5, ML, MR, and MT are controlled.

The fluid passage 50 may include, for example, a hose or a pipe made of a material such as metal. The fluid passage 50 is a flow passage that connects each unit provided in the hydraulic circuit K and allows the hydraulic fluid or pilot fluid to flow to each unit. The fluid passage 50 includes a first fluid passage 51, a second fluid passage 52, a first suction fluid passage 54, a second suction fluid passage 55, and a restriction fluid passage 57.

The first suction fluid passage 54 is a flow passage through which the hydraulic fluid sucked from the hydraulic fluid tank 48 by the actuation hydraulic pump P1 flows. The second suction fluid passage 55 is a flow passage through which the hydraulic fluid sucked from the hydraulic fluid tank 48 by the control hydraulic pump P2 flows. The first fluid passage 51 is a flow passage through which the hydraulic fluid delivered from the actuation hydraulic pump P1 flows toward the control valves V1 to V8 of the control valve CV. The first fluid passage 51 branches into a plurality of passages within the control valve CV and is connected to each of the control valves V1 to V8. The second fluid passage 52 is a flow passage through which the hydraulic fluid that has passed through the control valves V1 to V8 flows toward the hydraulic fluid tank 48. The hydraulic fluid tank 48 stores the hydraulic fluid. The second fluid passage 52 includes at least one reciprocating fluid passage 52*a* and a drain fluid passage 52*b*.

A plurality of reciprocating fluid passages 52*a* are provided so as to connect each of the control valves V1 to V8 to a corresponding one of the hydraulic actuators C1 to C5, ML, MR, and MT to be controlled. The reciprocating fluid passage 52*a* is a flow passage that supplies the hydraulic fluid from the connected control valves V1 to V8 to the hydraulic actuators C1 to C5, ML, MR, and MT and returns the hydraulic fluid from the hydraulic actuators C1 to C5, ML, MR, and MT to the control valves V1 to V8. One end of the drain fluid passage 52*b* branches into a plurality of passages connected to the respective control valves V1 to V8. The other end of the drain fluid passage 52*b* is connected to the hydraulic fluid tank 48.

A portion of the hydraulic fluid that flows through the first fluid passage 51 to any one of the control valves V1 to V8 passes through the one of the control valves V1 to V8 and one side of the reciprocating fluid passage 52*a* and is supplied to any one of the hydraulic actuators C1 to C5, ML, MR, and MT to be controlled. Then, the hydraulic fluid delivered from the one of the hydraulic actuators C1 to C5, ML, MR, and MT returns to the connected one of the control valves V1 to V8 through the other side of the reciprocating fluid passage 52*a*, passes through the one of the control valves V1 to V8, and flows into the drain fluid passage 52*b*.

Another portion of the hydraulic fluid that flows through the first fluid passage 51 to any one of the control valves V1 to V8 passes through the one of the control valves V1 to V8 and flows into the drain fluid passage 52*b* without being supplied to the hydraulic actuators C1 to C5, ML, MR, and MT. The drain fluid passage 52*b* is provided with the oil cooler 37. The oil cooler 37 cools the hydraulic fluid that flows from any one of the control valves V1 to V8 through the drain fluid passage 52*b*.

The hydraulic fluid cooled in the oil cooler 37 returns to the hydraulic fluid tank 48 through the drain fluid passage 52*b*. As described above, the fluid passages 54, 51, and 52 are arranged to circulate the hydraulic fluid to the hydraulic fluid tank 48, the hydraulic pump P1, and the control valves V1 to V8 of the control valve CV (part of the hydraulic fluid is also circulated to the hydraulic actuators C1 to C5, ML, MR, and MT).

The restriction fluid passage 57 is a flow passage through which the hydraulic fluid delivered by the control hydraulic pump P2 flows to the operation valves PV1 to PV6. One end of the restriction fluid passage 57 is connected to the control hydraulic pump P2, and the other end thereof is branched into a plurality of passages connected to the primary ports (primary ports) of the respective operation valves PV1 to PV6.

The restriction fluid passage 57 is provided with the unload valve 58, which is a two-position switching valve. The unload valve 58 switches between a first position 58*a* and a second position 58*b* in response to the operation of the unload lever 5*c* (FIG. 1). When the unload valve 58 is switched to the first position 58*a*, the hydraulic fluid is supplied from the actuation hydraulic pump P1 to the hydraulic actuators C1 to C5, ML, MR, and MT, permitting the actuation of the hydraulic actuators C1 to C5, ML, MR, and MT, the working device 20, and the traveling device 10. In addition, when the unload valve 58 is switched to the second position 58*b*, the supply of the hydraulic fluid from the actuation hydraulic pump P1 to the hydraulic actuators C1 to C5, ML, MR, and MT is interrupted, not permitting the actuation of the hydraulic actuators C1 to C5, ML, MR, and MT, the working device 20, and the traveling device 10 (actuation prohibited state).

Specifically, when the unload lever 5*c* is operated to be in the load position (first position), the unload valve 58 is switched to the first position (fluid supply position, load position) 58*a* by the controller 7, and the hydraulic fluid delivered from the control hydraulic pump P2 to the restriction fluid passage 57 is supplied to the operation valves PV1 to PV6, making the control valves V1 to V8 operable. This also makes it possible to operate the hydraulic actuators C1 to C5, ML, MR, and MT, the working device 20, and the traveling device 10, and the actuation of these units C1 to C5, ML, MR, MT, 20, and 10 is permitted. The hydraulic fluid delivered from the operation valves PV1 to PV6 returns to the hydraulic fluid tank 48 through a separate drain fluid passage (not illustrated).

When the unload lever 5*c* is operated to be in the unload position (second position), the unload valve 58 is switched to the second position (fluid interrupted position, unload position) 58*b* by the controller 7, and the hydraulic fluid delivered from the control hydraulic pump P2 to the restriction fluid passage 57 is not supplied to the operation valves PV1 to PV6, making the control valves V1 to V8 inoperable (operation prohibited state). This also makes it not possible to operate the hydraulic actuators C1 to C5, ML, MR, and MT, the working device 20, and the traveling device 10, and the actuation of these units C1 to C5, ML, MR, MT, 20, and 10 is not permitted. Not only the unload lever 5*c* but also the unload valve 58 is an example of a configuration included in the "switch".

In addition to the above, the hydraulic circuit K is provided with an operation detection fluid passage (not illustrated) to detect the operation states of the control valves V1 to V8. The operation detection fluid passage is a fluid passage that returns the pilot fluid delivered from the control hydraulic pump P2 to the hydraulic fluid tank 48 via a plurality of switching valves to switch the positions of the control valves V1 to V8. In the operation detection fluid passage, the AI-SW 45 (FIG. 1) is connected upstream of the control valve V1, which is disposed closest to the control hydraulic pump P2.

When any one of the control valves V1 to V8 is operated from the neutral position to the switching position, a portion of the operation detection fluid passage is blocked, the pressure of the pilot fluid in the operation detection fluid passage increases to a certain degree (a so-called pressurized state), and the AI-SW 45 is turned on. That is, the AI-SW 45 detects the actuation of at least one of the working devices 20 and 10. In addition, when all of the control valves V1 to V8 are in the neutral position, the above operation detection fluid passage is open, so that the pressure of the pilot fluid in the operation detection fluid passage does not increase to a certain degree (a so-called not-pressurized state), and the AI-SW 45 is turned off. That is, the AI-SW 45 detects no actuation of the working devices 20 and 10.

Figure 3:
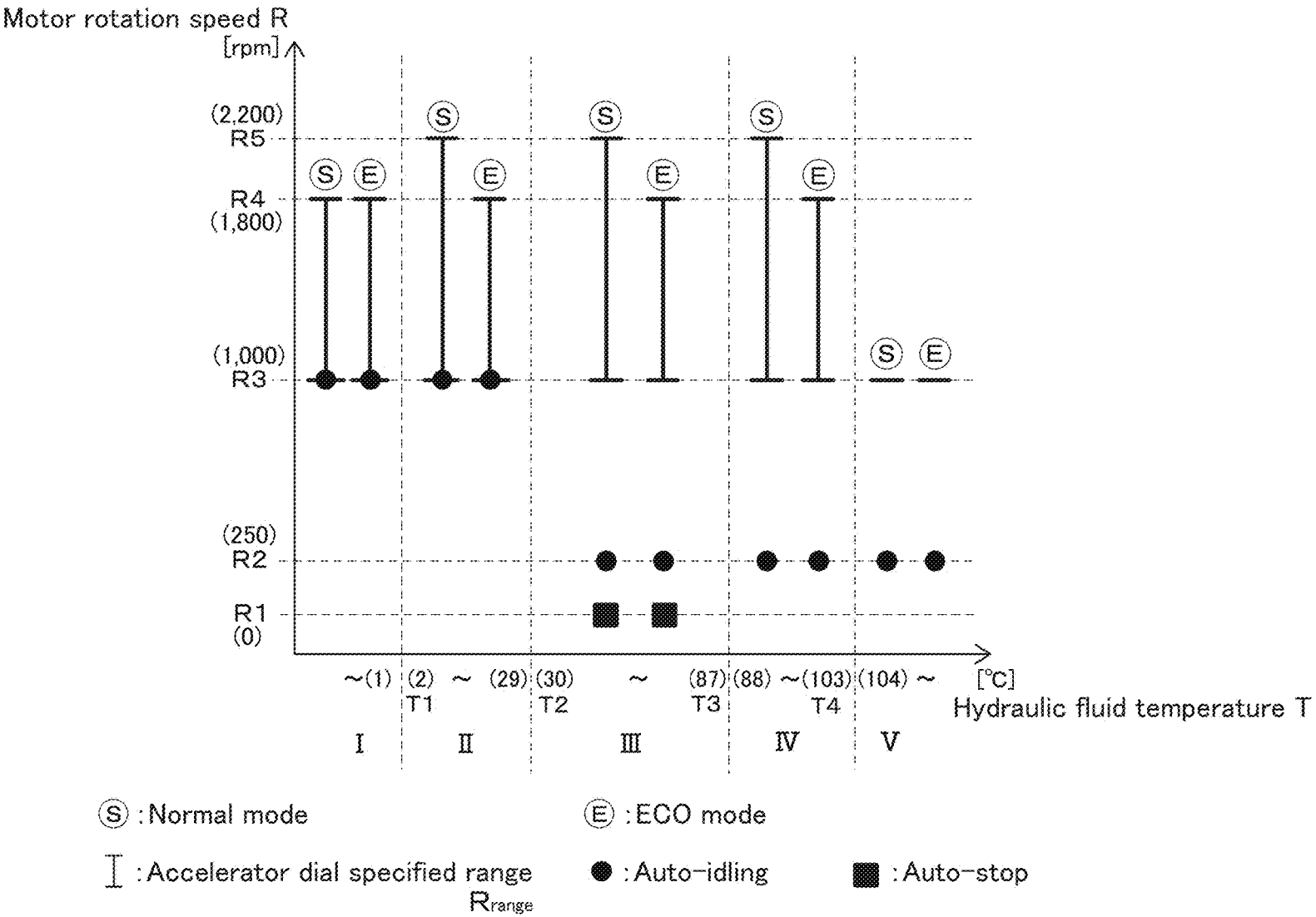
FIG. 3 is a diagram illustrating an example of a control map for a rotation speed of an electric motor.

Next, the operation of the electric working machine 1 will be described. FIG. 3 is a diagram illustrating an example of a control map for the rotation speed of the electric motor 9. Specifically, the control map in FIG. 3 illustrates a graph of a correlation between the hydraulic fluid temperature and a control value for the rotation speed of the electric motor 9. In the control map in FIG. 3, the horizontal axis represents the hydraulic fluid temperature [° C.], and the vertical axis represents the rotation speed [rpm] of the electric motor 9. The data representing the control map in FIG. 3 is stored in advance in the storage 7*b* (FIG. 1) of the controller 7.

The controller 7 determines whether a hydraulic fluid temperature T detected by the fluid temperature detector 44 is in any one of five predetermined temperature ranges I to V illustrated in FIG. 3. The third temperature range III is an allowable temperature range and is higher than or equal to a predetermined temperature T2 (for example, 30° C.) and lower than or equal to a predetermined temperature T3 (for example, 87° C.). The temperatures T2 and T3 and the allowable temperature range T2 to T3 are set to, for example, hydraulic fluid temperatures and a temperature range that allow each unit of the electric working machine 1 to operate stably.

Of the temperature ranges I and II, which are lower than the allowable temperature range III, the first temperature range I is set to temperatures lower than a predetermined temperature T1 (for example, 2° C.). The second temperature range II is set to temperatures higher than or equal to the temperature T1 and lower than the temperature T2. Of the temperature ranges IV and V, which are higher than the allowable temperature range III, the fourth temperature range IV is set to temperatures higher than the temperature T3 and lower than or equal to a predetermined temperature T4 (for example, 103° C.). The temperature T1 is an example of the "first temperature", and the temperature T4 is an example of the "second temperature". The fourth temperature range IV is set to temperatures higher than the temperature T4 (for example, 103° C.).

The controller 7 controls a rotation speed R of the electric motor 9 within predetermined ranges R1 to R5 according to the hydraulic fluid temperature T, the unload lever 5*c*, and the state of the AI-SW 45 while the electric motor 9 is being driven. The first rotation speed R1 is a rotation speed (for example, 0 rpm) that corresponds to a stopped state of the electric motor 9.

The second rotation speed R2 is a rotation speed (for example, 250 rpm) of the electric motor 9 at which a hydraulic pressure of the hydraulic fluid can be generated, the hydraulic pressure enabling the AI-SW 45 to detect whether the working devices 20 and 10 are actuated. More specifically, the second rotation speed R2 is set to the rotation speed of the electric motor 9 to generate a hydraulic pressure higher than or equal to the minimum hydraulic pressure of the hydraulic fluid, at which the AI-SW 45 can be turned on when at least one of the working devices 20 and 10 is actuated, and the AI-SW 45 can be turned off when the working devices 20 and 10 are not actuated.

The third rotation speed R3 is the lower limit (for example, 1,000 rpm) of the rotation speed of the electric motor 9 for the working devices 20 and 10 to perform work. More specifically, the third rotation speed R3 is set to a rotation speed in a no-load state of the electric motor 9 that can instantly actuate the working devices 20 and 10 in response to the operation of the operation levers 5*a* and 5*b*. The third rotation speed R3 is a rotation speed higher than the first rotation speed R1 and the second rotation speed R2 and is also an idling rotation speed. The second rotation speed R2 is a rotation speed higher than the first rotation speed R1 and lower than the third rotation speed R3. The second rotation speed R2 is also an idling rotation speed lower than the rotation speed of the electric motor 9 when the working devices 20 and 10 perform work.

The fifth rotation speed R5 is the predetermined maximum rotation speed (for example, 2,200 rpm) that can be set for the electric motor 9. The fourth rotation speed R4 is a rotation speed (for example, 1,800 rpm) that is limited to be lower than the fifth rotation speed R5 and is higher than the third rotation speed R3.

Note that the above-described numerical values of the temperatures TI to T4 and the rotation speeds R1 to R5 are examples and are not limited to the above. In addition, the first rotation speed R1 corresponding to the stopped state of the electric motor 9 is not limited to 0 rpm and may be an extremely low rotation speed, for example, lower than 1 rpm. Furthermore, in this example, when the controller 7 sets the rotation speed of the electric motor 9 to 0 rpm (first rotation speed), the controller 7 continues the electric power supply from the inverter 38 to the electric motor 9. However, for example, the controller 7 may interrupt the electric power supply from the inverter 38 to the electric motor 9 to completely stop the electric motor 9, thus setting the rotation speed of the electric motor 9 to 0 rpm.

Figure 4A:
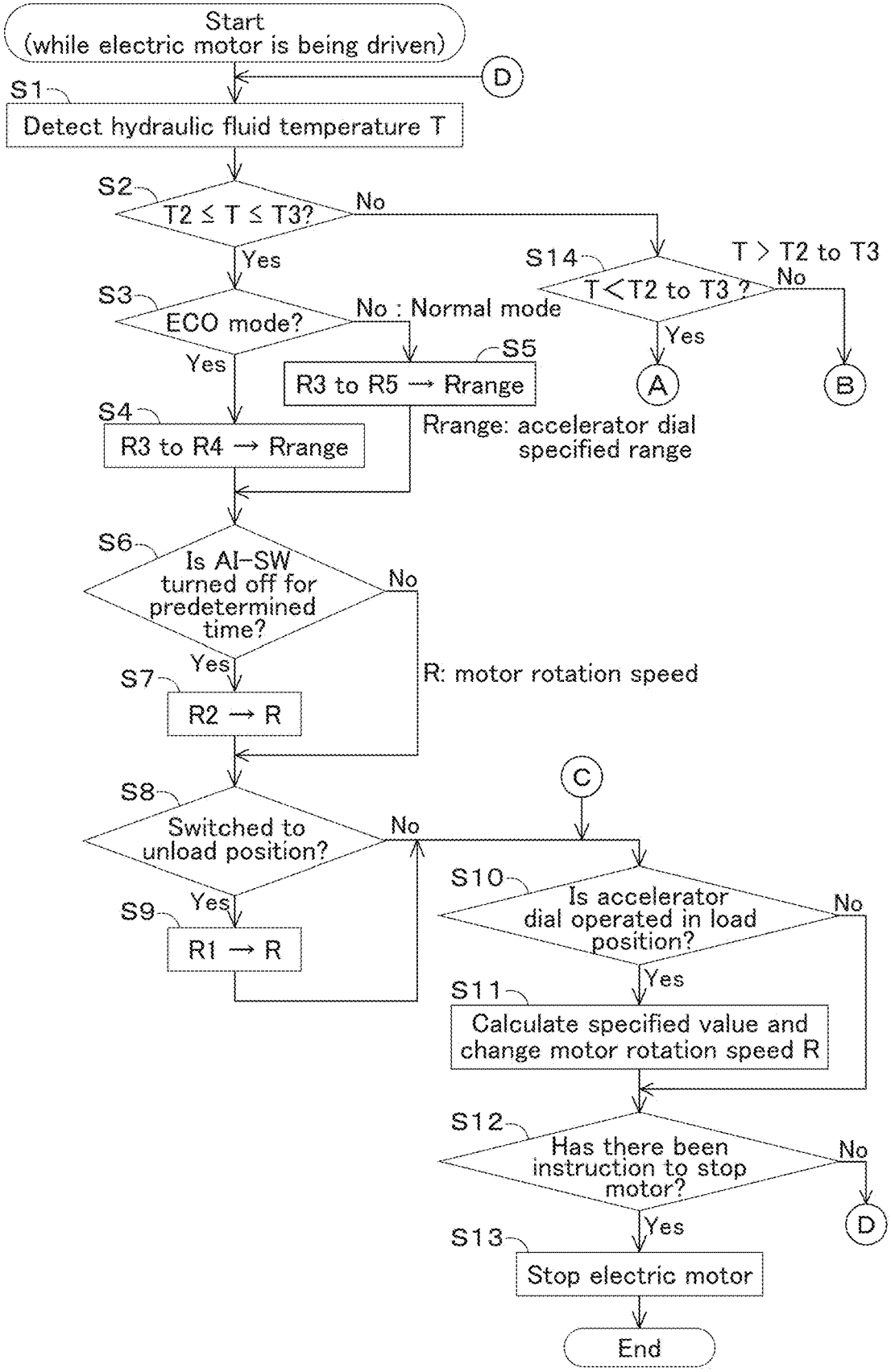
FIG. 4A is a flowchart illustrating control operations of the rotation speed of the electric motor.
Figure 4B:
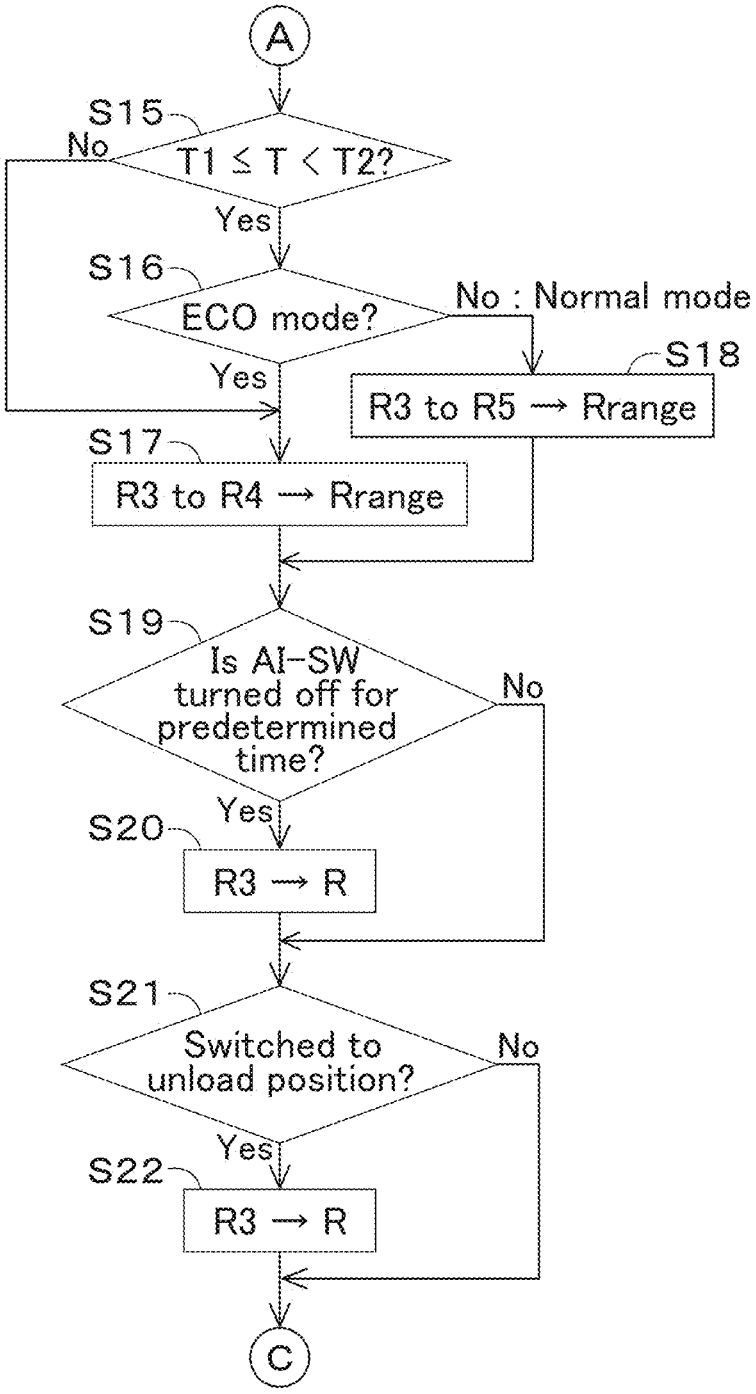
FIG. 4B is a flowchart illustrating control operations of the rotation speed of the electric motor.
Figure 4C:
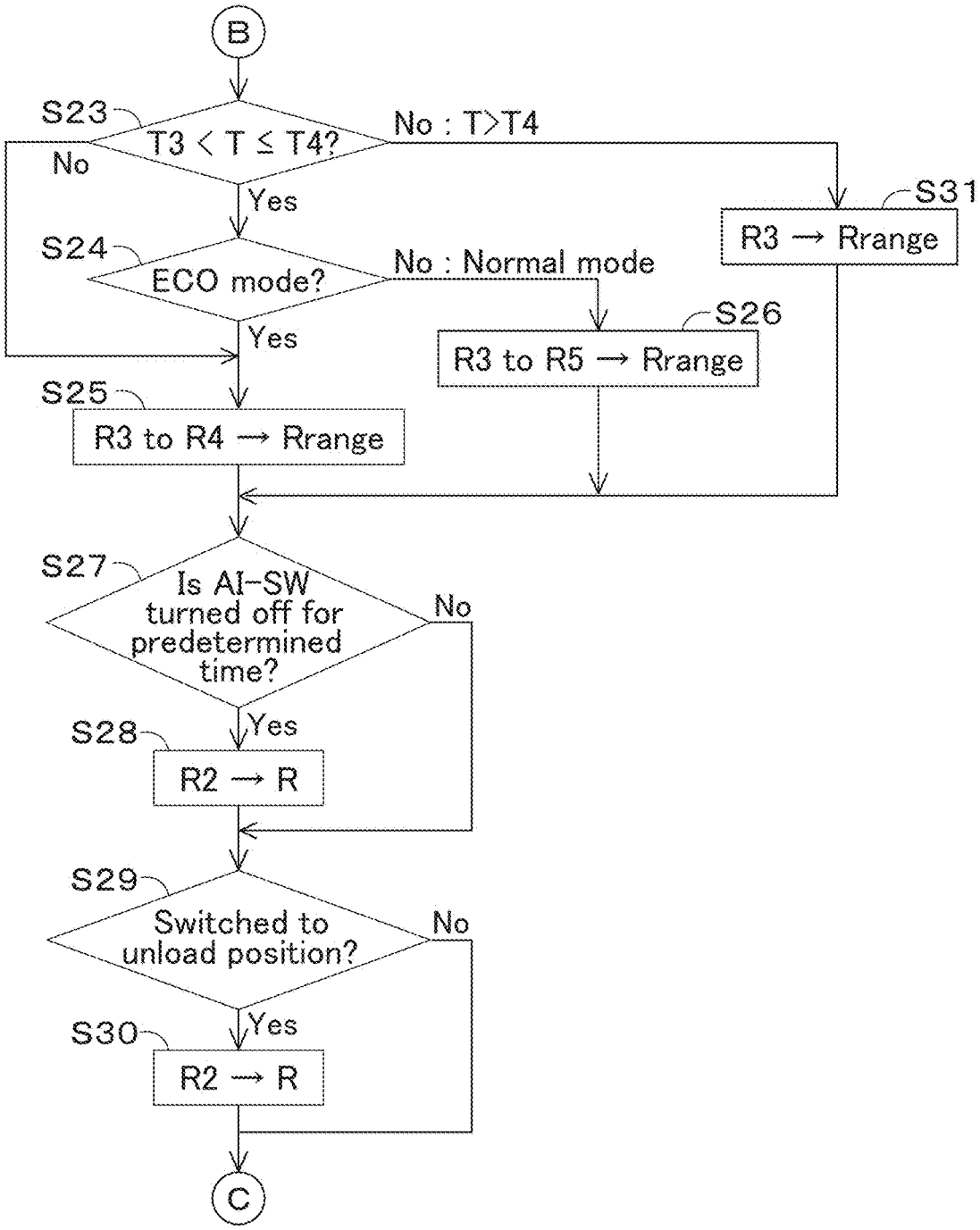
FIG. 4C is a flowchart illustrating control operations of the rotation speed of the electric motor.

FIGS. 4A to 4C are flowcharts illustrating control operations of the rotation speed of the electric motor 9 in the electric working machine 1. The series of control operations illustrated in FIGS. 4A to 4C are executed by the CPU 7*a* (FIG. 1) of the controller 7, based on a software program and the control map in FIG. 3 that are stored in advance in the storage 7*b*. Hereinafter, for convenience, the rotation speed of the electric motor 9 will be referred to as "motor rotation speed."

In response to the operator turning on the starter SW 8, the controller 7 starts the electric motor 9 by the inverter 38. While the electric motor 9 is being driven, the controller 7 detects the hydraulic fluid temperature T by the fluid temperature detector 44 (S1 in FIG. 4A). When the hydraulic fluid temperature T is within the predetermined allowable temperature range III (higher than or equal to the temperature T2 and lower than or equal to the temperature T3) (S2: YES in FIG. 4A), the controller 7 checks the mode selected by the mode selection SW 5*e* (FIG. 1). At this time, when the normal mode is selected by the mode selection SW 5*e* (S3: NO in FIG. 4A), the controller 7 sets a specified range Rrange for the motor rotation speed R by the accelerator dial 5*d* (FIG. 1) to be higher than or equal to the third rotation speed R3 and lower than or equal to the fifth rotation speed R5 (S5 in FIG. 4A, circled S in the allowable temperature range III in FIG. 3). That is, the controller 7 sets the third rotation speed R3 as the lower limit of the specified range Rrange for the motor rotation speed R by the accelerator dial 5*d* and sets the fifth rotation speed R5 as the upper limit thereof.

On the other hand, when the ECO mode is selected by the mode selection SW 5*e* (S3: YES in FIG. 4A), the controller 7 sets the specified range Rrange for the motor rotation speed R by the accelerator dial 5*d* to be higher than or equal to the third rotation speed R3 and lower than or equal to the fourth rotation speed R4 (S4 in FIG. 4A, circled E in the allowable temperature range III in FIG. 3). That is, the controller 7 sets the third rotation speed R3 as the lower limit of the specified range Rrange for the motor rotation speed R by the accelerator dial 5*d* and sets the fourth rotation speed R4 as the upper limit thereof.

When the working devices 20 and 10 are not actuated for a predetermined time (for example, 4 seconds) or longer and the AI-SW 45 is turned off for a predetermined time (for example, 4 seconds) or longer (S6: YES in FIG. 4A), the controller 7 controls the motor rotation speed R to coincide with the second rotation speed R2 (S7 in FIG. 4A, black circles in the allowable temperature range III in FIG. 3). S6 and S7 in FIG. 4A are so-called AI (auto-idling) control.

When the unload lever 5*c* (FIG. 1) and the unload valve 58 (FIG. 2) are switched to the unload position (S8: YES in FIG. 4A), the controller 7 controls the motor rotation speed R to coincide with the first rotation speed R1 (S9 in FIG. 4A, black squares in the allowable temperature range III in FIG. 3). As a result, the electric motor 9 stops rotating. S8 and S9 in FIG. 4A are so-called AS (auto-stop) control.

When the accelerator dial 5*d* is operated in a state in which the unload lever 5*c* and the unload valve 58 are in the load position (S10: YES in FIG. 4A), the controller 7 calculates a specified value for the motor rotation speed R according to the operating position of the accelerator dial 5*d* and changes the motor rotation speed R to coincide with the specified value (S11 in FIG. 4A).

At this time, since the hydraulic fluid temperature T is in the allowable temperature range III, when the normal mode is selected by the mode selection SW 5*e*, the controller 7 calculates the specified value for the motor rotation speed R according to the operating position of the accelerator dial 5*d* within the specified range Rrange (R3 to R5) set in S5 in FIG. 4A. In addition, when the ECO mode is selected by the mode selection SW 5*e*, the controller 7 calculates the specified value for the motor rotation speed R according to the operating position of the accelerator dial 5*d* within the specified range Rrange (R3 to R4) set in S4 in FIG. 4A.

Subsequently, in response to the operator turning off the starter SW 8, the controller 7 determines that there has been an instruction to stop the electric motor 9 (S12: YES in FIG. 4A) and stops the electric power supply to the electric motor 9 by the inverter 38, thus stopping the driving of the electric motor 9 (S13 in FIG. 4A). As a result, the electric working machine 1 enters the stopped state.

On the other hand, when the operator does not turn off the starter SW 8, the controller 7 determines that there is no instruction to stop the electric motor 9 (S12: NO in FIG. 4A) and executes the process in and after S1 again. In this case, the electric motor 9 is being driven.

When the hydraulic fluid temperature T is outside the allowable temperature range III (T2 to T3) (S2: NO in FIG. 4A) and the hydraulic fluid temperature T is lower than the allowable temperature range III (S14: YES in FIG. 4A), the controller 7 further determines whether the hydraulic fluid temperature T is in the temperature range I or II.

For example, when the hydraulic fluid temperature T is in the low temperature range II higher than or equal to the temperature T1 and lower than the temperature T2 (S15: YES in FIG. 4B), the controller 7 checks the mode selected by the mode selection SW 5*e*. At this time, when the normal mode is selected by the mode selection SW 5*e* (S16: NO in FIG. 4B), the controller 7 sets the specified range Rrange for the motor rotation speed R by the accelerator dial 5*d* to be higher than or equal to the third rotation speed R3 and lower than or equal to the fifth rotation speed R5 (S18 in FIG. 4B, circled S in the low temperature range II in FIG. 3).

On the other hand, when the ECO mode is selected by the mode selection SW 5*e* (S16: YES in FIG. 4B), the controller 7 sets the specified range Rrange for the motor rotation speed R by the accelerator dial 5*d* to be higher than or equal to the third rotation speed R3 and lower than or equal to the fourth rotation speed R4 (S17 in FIG. 4B, circled E in the low temperature range II in FIG. 3).

When the AI-SW 45 is turned off for a predetermined time or longer (S19: YES in FIG. 4B), the controller 7 controls the motor rotation speed R to coincide with the third rotation speed R3 (S20 in FIG. 4B, black circles in the low temperature range II in FIG. 3). S19 and S20 in FIG. 4B are also AI control.

Even when the unload lever 5*c* and the unload valve 58 are switched to the unload position (S21: YES in FIG. 4B), the controller 7 controls the motor rotation speed R to coincide with the third rotation speed R3 (S22 in FIG. 4B). In other words, as long as the hydraulic fluid temperature T is in the temperature range II, which is lower than the allowable temperature range III, even when the operator switches the unload lever 5*c* to the unload position to indicate an intention not to actuate the working devices 20 and 10, the controller 7 does not execute AS (auto-stop) control, but continues to rotationally drive the electric motor 9 at the third rotation speed R3 or higher to circulate the hydraulic fluid for warming up. S19 to S22 in FIG. 4B are so-called warming-up control.

When the accelerator dial 5*d* is operated in a state in which the unload lever 5*c* and the like are in the load position (S10: YES in FIG. 4A), the controller 7 calculates the specified value for the motor rotation speed R according to the operating position of the accelerator dial 5*d* and changes the motor rotation speed R to coincide with the specified value (S11 in FIG. 4A).

At this time, since the hydraulic fluid temperature T is in the low temperature range II, when the normal mode is selected by the mode selection SW 5*e*, the controller 7 calculates the specified value for the motor rotation speed R according to the operating position of the accelerator dial 5*d* within the specified range Rrange (R3 to R5) set in S18 in FIG. 4B. In addition, when the ECO mode is selected by the mode selection SW 5*e*, the controller 7 calculates the specified value for the motor rotation speed R according to the operating position of the accelerator dial 5*d* within the specified range Rrange (R3 to R4) set in S17 in FIG. 4B.

When the hydraulic fluid temperature T is in the extremely low temperature range I lower than the temperature T1 (S15: NO in FIG. 4B, T<T1), regardless of whether the normal mode or the ECO mode is selected by the mode selection SW 5*e*, the controller 7 sets the specified range Rrange for the motor rotation speed R by the accelerator dial 5*d* to be higher than or equal to the third rotation speed R3 and lower than or equal to the fourth rotation speed R4 (S17 in FIG. 4B, circled S and circled E in the extremely low temperature range I in FIG. 3).

Even when the AI-SW 45 is turned off for a predetermined time or longer (S19: YES in FIG. 4B) or the unload lever 5*c* and the like are switched to the unload position (S21: YES in FIG. 4B), the controller 7 controls the motor rotation speed R to coincide with the third rotation speed R3 (S20 and S22 in FIG. 4B, black circles in the extremely low temperature range I in FIG. 3). In other words, as long as the hydraulic fluid temperature T is in the extremely low temperature range I, which is lower than the allowable temperature range III and the low temperature range II, even when the unload lever 5*c* is switched to the unload position to indicate an intention not to actuate the working devices 20 and 10, the controller 7 does not execute AS (auto-stop) control, but continues to rotationally drive the electric motor 9 at the third rotation speed R3 or higher to circulate the hydraulic fluid for warming up.

When the accelerator dial 5*d* is operated in a state in which the unload lever 5*c* and the like are in the load position (S10: YES in FIG. 4A), the controller 7 calculates the specified value for the motor rotation speed R according to the operating position of the accelerator dial 5*d* and changes the motor rotation speed R to coincide with the specified value (S11 in FIG. 4A). At this time, since the hydraulic fluid temperature Tis in the extremely low temperature range I, regardless of whether the normal mode or the ECO mode is selected by the mode selection SW Se, the controller 7 calculates the specified value for the motor rotation speed R according to the operating position of the accelerator dial 5*d* within the specified range Rrange (R3 to R4) set in S17 in FIG. 4B.

When the hydraulic fluid temperature T is outside the allowable temperature range III (T2 to T3) (S2: NO in FIG. 4A) and the hydraulic fluid temperature T is higher than the allowable temperature range III (S14: NO in FIG. 4A), the controller 7 further determines whether the hydraulic fluid temperature T is in the temperature range IV or V.

For example, when the hydraulic fluid temperature T is in the high temperature range IV higher than the temperature T3 and lower than or equal to the temperature T4 (S23: YES in FIG. 4C), the controller 7 checks the mode selected by the mode selection SW 5*e*. At this time, when the normal mode is selected by the mode selection SW 5*e* (S24: NO in FIG. 4C), the controller 7 sets the specified range Rrange for the motor rotation speed R by the accelerator dial 5*d* to be higher than or equal to the third rotation speed R3 and lower than or equal to the fifth rotation speed R5 (S26 in FIG. 4C, circled S in the high temperature range IV in FIG. 3).

On the other hand, when the ECO mode is selected by the mode selection SW 5*e* (S24: YES in FIG. 4C), the controller 7 sets the specified range Rrange for the motor rotation speed R by the accelerator dial 5*d* to be higher than or equal to the third rotation speed R3 and lower than or equal to the fourth rotation speed R4 (S25 in FIG. 4C, circled E in the high temperature range IV in FIG. 3).

When the AI-SW 45 is turned off for a predetermined time or longer (S27: YES in FIG. 4C), the controller 7 controls the motor rotation speed R to coincide with the second rotation speed R2 (S28 in FIG. 4C, black circles in the high temperature range IV in FIG. 3). S27 and S28 in FIG. 4C are also AI control.

Even when the unload lever 5*c* and the unload valve 58 are switched to the unload position (S29: YES in FIG. 4C), the controller 7 controls the motor rotation speed R to coincide with the second rotation speed R2 (S30 in FIG. 4C, black circles in the high temperature range IV in FIG. 3). In other words, as long as the hydraulic fluid temperature T is in the high temperature range IV, which is higher than the allowable temperature range III, even when the unload lever 5*c* is switched to the unload position to indicate an intention not to actuate the working devices 20 and 10, the controller 7 does not execute AS (auto-stop) control, but continues to rotationally drive the electric motor 9 at the second rotation speed R2, which is lower than third rotation speed R3, to circulate the hydraulic fluid for cooling the hydraulic fluid. S27 to S30 in FIG. 4C are so-called cooling control.

When the accelerator dial 5*d* is operated in a state in which the unload lever 5*c* and the like are in the load position (S10: YES in FIG. 4A), the controller 7 calculates the specified value for the motor rotation speed R according to the operating position of the accelerator dial 5*d* and changes the motor rotation speed R to coincide with the specified value (S11 in FIG. 4A).

At this time, since the hydraulic fluid temperature T is in the high temperature range IV, when the normal mode is selected by the mode selection SW 5*e*, the controller 7 calculates the specified value for the motor rotation speed R according to the operating position of the accelerator dial 5*d* within the specified range Rrange (R3 to R5) set in S26 in FIG. 4C. In addition, when the ECO mode is selected by the mode selection SW 5*e*, the controller 7 calculates the specified value for the motor rotation speed R according to the operating position of the accelerator dial 5*d* within the specified range Rrange (R3 to R4) set in S25 in FIG. 4C.

When the hydraulic fluid temperature T is in the extremely high temperature range V higher than the temperature T4 (S23: NO in FIG. 4C, T>T4), regardless of whether the normal mode or the ECO mode is selected by the mode selection SW 5*e*, the controller 7 sets the upper limit and the lower limit of the specified range Rrange for the motor rotation speed R by the accelerator dial 5*d* to be the third rotation speed R3 (S31 in FIG. 4C, circled S and circled E in the extremely high temperature range V in FIG. 3). That is, when the hydraulic fluid temperature T is within the extremely high temperature range V, the specified range Rrange for the motor rotation speed R by the accelerator dial 5*d* is set to the constant third rotation speed R3. Therefore, regardless of whether the accelerator dial 5*d* is operated to any position from the neutral position, the specified value for the motor rotation speed R becomes the third rotation speed R3, and the rotation speed R of the electric motor 9 is limited to the third rotation speed R3.

Even when the AI-SW 45 is turned off for a predetermined time or longer (S27: YES in FIG. 4C) or the unload lever 5*c* and the like are switched to the unload position (S29: YES in FIG. 4C), the controller 7 controls the motor rotation speed R to coincide with the second rotation speed R2 (S30 in FIG. 4C, black circles in the extremely high temperature range V in FIG. 3). In other words, as long as the hydraulic fluid temperature T is in the extremely high temperature range V, even when the unload lever 5*c* is switched to the unload position to indicate an intention not to actuate the working devices 20 and 10, the controller 7 does not execute AS control, but continues to rotationally drive the electric motor 9 at the second rotation speed R2 to circulate the hydraulic fluid for cooling the hydraulic fluid.

When the accelerator dial 5*d* is operated in a state in which the unload lever 5*c* and the like are in the load position (S10: YES in FIG. 4A), the controller 7 calculates the specified value for the motor rotation speed R and changes the motor rotation speed R to coincide with the specified value (S11 in FIG. 4A). At this time, since the hydraulic fluid temperature T is in the extremely high temperature range V, regardless of the mode selected by the mode selection SW 5*e* and the operating position of the accelerator dial 5*d*, the controller 7 determines the constant value R3 set in S31 in FIG. 4C as the specified value for the motor rotation speed R.

In a case in which the hydraulic fluid temperature T is in the temperature range IV or V, which is higher than the allowable temperature range III, the controller 7 may cool the hydraulic fluid by rotationally driving the fan motor 37*a* of the oil cooler 37 at a predetermined rotation speed when controlling the motor rotation speed R to coincide with the second rotation speed R2. In other words, when the working devices 20 and 10 are not actuated, while the electric motor 9 is rotated at the second rotation speed R2, the oil cooler 37 is driven to cool the hydraulic fluid.

In a case in which the hydraulic fluid temperature T is lower than the allowable temperature range III, the controller 7 may reduce electric power consumption and promote warming up of the hydraulic fluid by stopping the oil cooler 37 when controlling the motor rotation speed R to coincide with the third rotation speed R3. Furthermore, also in a case in which the hydraulic fluid temperature T is within the allowable temperature range III, the controller 7 may reduce electric power consumption by stopping the oil cooler 37 when controlling the motor rotation speed R to coincide with the first rotation speed R1 or the second rotation speed R2.

The above example embodiments have illustrated an example in which the temperature range of the hydraulic fluid temperature T is divided into five, which are the first to fifth temperature ranges I to V, for example. However, example embodiments of the present invention are not limited to this. For example, the temperature range of the hydraulic fluid temperature T may be divided into two, which are inside the allowable temperature range and outside the allowable temperature range. Alternatively, the temperature range of the hydraulic fluid temperature T may be divided into three, which are within the allowable temperature range, a temperature range lower than the allowable temperature range, and a temperature range higher than the allowable temperature range. Further alternatively, the temperature range of the hydraulic fluid temperature T may be divided into four, or six or more. In addition, as the motor rotation speed R when performing AI control in each temperature range, three or more predetermined rotation speeds may be set in addition to the two rotation speeds, which are the second rotation speed R2 and the third rotation speed R3.

The above example embodiments have illustrated an example in which the second to fourth rotation speeds R2 to R4 of the electric motor 9 are set to constant values. However, example embodiments of the present invention are not limited to this. For example, the controller 7 may change the second to fourth rotation speeds R2 to R4 according to the remaining capacity of the battery packs 31 and 32 provided in the battery 30. Specifically, as the remaining capacity of the battery packs 31 and 32 decreases, at least one of the second to fourth rotation speeds R2 to R4 may be changed to be lower.

The above example embodiments have illustrated an example in which the work operation lever 5*a* and the travel operation lever 5*b* are used as the work operation interfaces, the unload lever 5*c* is used as the switch and the unload operation interface, the mode selection SW 5*e* is used as the selector, and the accelerator dial 5*d* is used as the specifier. However, the example embodiments of the present invention is not limited to these. For example, various operation interfaces such as a lever, a joystick, a slide switch, a tumbler switch, a push button, a dial, and a key may be used as the work operation interface, the switch, the unload operation interface, the selector, and the specifier. In addition, for example, the unload valve 58 may be a mechanically actuated valve or an electrically actuated solenoid valve.

The above example embodiments have illustrated an example in which the AI-SW 45 made up of a pressure switch is used as the work detector. However, the example embodiments of the present invention are not limited to this. For example, a potentiometer, a sensor, a switch, or the like that detects whether the work operation lever 5*a* and the travel operation lever 5*b* are operated may be used as the work detector.

An electric working machine 1 of the present example embodiment has the following configuration and provides the following effects.

An electric working machine 1 of the present example embodiment includes a machine body 2, a battery 30 mounted on the machine body 2, an electric motor 9 to be driven by the electric power from the battery 30, at least one hydraulic device (at least one of hydraulic motors ML, MR, and MT, at least one of hydraulic cylinders C1 to C5, at least one of hydraulic pumps P1 and P2, and/or control valve CV) to be actuated by the power from the electric motor 9, at least one working device 20 or 10 (working device 20 or traveling device 10) to be actuated by a hydraulic pressure of a hydraulic fluid supplied from the at least one hydraulic device, a controller 7 to control driving of the electric motor 9, at least one switch 5*c* or 58 (unload lever 5*c* or unload valve 58) operable to be switched between a first position to permit actuation of the at least one working device 20 or 10 and a second position to not permit the actuation of the at least one working device 20 or 10, and a fluid temperature detector 44 to detect a temperature T of the hydraulic fluid, and the controller 7 is configured or programmed to, while the electric motor 9 is being driven, when the at least one switch 5*c* or 58 is switched to the second position and the temperature T of the hydraulic fluid is within a predetermined allowable temperature range III (predetermined temperatures T2 to T3) that is neither in a low temperature state nor a high temperature state, control a rotation speed R of the electric motor 9 to a predetermined first rotation speed R1 corresponding to a stopped state of the electric motor 9.

According to the above configuration, since the operator does not operate the electric working machine 1, when the at least one switch 5*c* or 58 is switched to the second position to not permit the actuation of the at least one working device 20 or 10, if the temperature T of the hydraulic fluid is within the allowable temperature range III, the rotation speed R of the electric motor 9 decreases to the first rotation speed R1 corresponding to the stopped state. Accordingly, it is possible to reduce or prevent wasteful consumption of the electric power of the battery 30 by the electric motor 9, thus reducing or preventing wasteful electric power consumption in the electric working machine 1 and improving the working efficiency. In addition, when the temperature T of the hydraulic fluid is outside the allowable temperature range III, that is, when the temperature T of the hydraulic fluid is in either the low temperature state or the high temperature state, the rotation speed R of the electric motor 9 is not controlled to the first rotation speed R1. Accordingly, the electric motor 9 continues to rotate without completely entering the stopped state, so that the hydraulic fluid can be circulated by at least one hydraulic device such as at least one hydraulic pump P1 or P2 to warm up or cool the hydraulic fluid, thus improving the working efficiency.

In the present example embodiment, the controller 7 is configured or programmed to, while the electric motor 9 is being driven, when the at least one switch 5*c* or 58 is switched to the second position and the temperature T of the hydraulic fluid is not within the allowable temperature range III, control the rotation speed R of the electric motor 9 to at least one predetermined idling rotation speed R2 or R3 higher than the first rotation speed R1 and lower than or equal to a lower limit of the rotation speed when the at least one working device 20 or 10 perform work.

From the above, when the at least one switch 5*c* or 58 is switched to the second position, the rotation speed R of the electric motor 9 is decreased to the first rotation speed R1 or the at least one idling rotation speed R2 or R3 depending on whether the temperature T of the hydraulic fluid is within the allowable temperature range III. Accordingly, wasteful electric power consumption can be reduced. In addition, the reduction in wasteful electric power consumption allows the operating time of the at least one working device 20 or 10 to be extended, thus improving the working efficiency.

In the present example embodiment, while the electric motor 9 is being driven, when the at least one switch 5*c* or 58 is switched to the second position, the controller 7 is configured or programmed to, if the temperature T of the hydraulic fluid is lower than the allowable temperature range III, control the rotation speed R of the electric motor 9 to coincide with a predetermined third rotation speed R3 for the at least one working device 20 or 10 to enter an idling state, and if the temperature T of the hydraulic fluid is higher than the allowable temperature range III, control the rotation speed R of the electric motor 9 to a predetermined second rotation speed R2 higher than the first rotation speed R1 and lower than the third rotation speed R3.

From the above, when the at least one switch 5*c* or 58 is switched to the second position and the temperature T of the hydraulic fluid is lower than the allowable temperature range III, the rotation speed R of the electric motor 9 is decreased to the third rotation speed R3. Accordingly, wasteful electric power consumption can be reduced, and the at least one hydraulic device such as the at least one hydraulic pump P1 or P2 can be actuated to circulate the hydraulic fluid for warming up, thus shortening the time taken for warming up. In addition, when the at least one switch 5*c* or 58 is switched to the second position and the temperature T of the hydraulic fluid is higher than the allowable temperature range III, the rotation speed R of the electric motor 9 is decreased to the second rotation speed R2, which is lower than the third rotation speed R3. Accordingly, wasteful electric power consumption can be reduced, and the hydraulic fluid can be circulated for cooling. Furthermore, as described above, when the at least one switch 5*c* or 58 is switched to the second position, the rotation speed R of the electric motor 9 is controlled to one of the first to third rotation speeds R1 to R3 according to the temperature T of the hydraulic fluid. Accordingly, wasteful electric power consumption can be reduced while maintaining a balance between warming up and cooling of the hydraulic fluid.

In the present example embodiment, the electric working machine 1 includes a work detector (AI-SW) 45 to be actuated by the hydraulic pressure of the hydraulic fluid so as to detect whether the at least one working device 20 or 10 is actuated, and the second rotation speed R2 is set to a rotation speed R such as to cause the hydraulic fluid to have a hydraulic pressure that enables the work detector 45 to detect whether the at least one working device 20 or 10 is actuated. Accordingly, even when the rotation speed R of the electric motor 9 is decreased to the second rotation speed R2, the work detector 45 can detect whether the at least one working device 20 or 10 is actuated.

In the present example embodiment, while the electric motor 9 is being driven, when the at least one switch 5*c* or 58 is in the first position and the working devices 20 and 10 are not actuated for a predetermined time or longer, the controller 7 is configured or programmed to control: if the temperature T of the hydraulic fluid is lower than the allowable temperature range III, the rotation speed R of the electric motor 9 to coincide with the third rotation speed R3, and if the temperature T of the hydraulic fluid is higher than or equal to the allowable temperature range III, control the rotation speed R of the electric motor 9 to the second rotation speed R2. Accordingly, when the at least one working device 20 or 10 is not actuated for the predetermined time or longer, the rotation speed R of the electric motor 9 is decreased to the third rotation speed R3 or the second rotation speed R2 depending on whether the temperature T of the hydraulic fluid is high or low relative to the allowable temperature range III, and wasteful electric power consumption can be reduced, and also, the hydraulic fluid can be circulated for warming up or cooling.

In the present example embodiment, the electric working machine 1 includes a specifier (for example, an accelerator dial) 5*d* to be operated to specify the rotation speed R of the electric motor 9, and the controller 7 is configured or programmed to set, according to the temperature T of the hydraulic fluid, the rotation speed R of the electric motor 9 specifiable by operation of the specifier 5*d*. In addition, while the electric motor 9 is being driven, the controller 7 is configured or programmed to calculate a specified value for the rotation speed R of the electric motor 9 according to an operation state of the specifier 5*d* and control the rotation speed R of the electric motor 9 to coincide with the specified value. Accordingly, the rotation speed R of the electric motor 9 can be controlled according to the operation state of the specifier 5*d* and the temperature T of the hydraulic fluid to circulate the hydraulic fluid at an appropriate flow rate and pressure, thus enabling the at least one working device 20 or 10 to be actuated stably.

In the present example embodiment, the controller 7 is configured or programmed to set a specified range Rrange for the motor rotation speed R specifiable by operation of the specifier 5*d* within the range from the third rotation speed R3 of the electric motor 9 for the at least one working device 20 or 10 so as to enter the idling state to a maximum rotation speed (fifth rotation speed) R5, which is an upper limit of the settable rotation speed of the electric motor 9. Accordingly, the rotation speed R of the electric motor 9 can be changed within an appropriate range according to the operation state of the specifier 5*d* and the temperature T of the hydraulic fluid.

In the present example embodiment, the electric working machine 1 includes a selector (for example, mode selection SW) 5*e* to select either a first mode (normal mode) or a second mode (ECO mode) that reduces electric power consumption more than the first mode, and the controller 7 is configured or programmed to, when the temperature T of the hydraulic fluid is within the allowable temperature range III, set an upper limit of a specified range Rrange for the rotation speed R of the electric motor 9 by operation of the specifier 5*d* when the second mode is selected by the selector 5*e* to be smaller than the upper limit of the specified range Rrange when the first mode is selected by the selector 5*e*. Accordingly, when the temperature T of the hydraulic fluid is neither in the extremely low temperature range I nor in the extremely high temperature range V, in response to the selection of the second mode, the upper limit of the rotation speed R of the electric motor 9 can be kept lower than the upper limit value of the rotation speed R when the first mode is selected, thus reducing electric power consumption.

In the present example embodiment, the controller 7 is configured or programmed to, when the temperature T of the hydraulic fluid is lower than a predetermined first temperature T1 lower than the allowable temperature range III, regardless of whether the first mode or the second mode is selected by the selector 5*e*, set the upper limit of the specified range Rrange for the rotation speed R of the electric motor 9 by the operation of the specifier 5*d* to a value smaller than a predetermined maximum rotation speed R5. The maximum rotation speed R5 is, for example, an upper limit of the rotation speed of the electric motor 9 specifiable by the specifier 5*d* when the temperature T of the hydraulic fluid is within the allowable temperature range III and the first mode is selected by the selector 5*e*. Accordingly, as long as the temperature T of the hydraulic fluid is in the extremely high temperature range V and the kinematic viscosity of the hydraulic fluid is high, even when the specifier 5*d* is operated to the maximum, the rotation speed R of the electric motor 9 can be kept lower than the maximum rotation speed R5, thus preventing cavitation from occurring in the at least one hydraulic device or at least one fluid passage through which the hydraulic fluid flows and reducing electric power consumption.

In present example embodiment, the controller 7 is configured or programmed to, when the temperature T of the hydraulic fluid is higher than a predetermined second temperature T4 higher than the allowable temperature range III, regardless of whether the first mode or the second mode is selected by the selector 5*e*, set the rotation speed R of the electric motor 9 specifiable by the specifier 5*d* to the third rotation speed R3 (upper limit and lower limit of the specified range Rrange). Accordingly, when the temperature T of the hydraulic fluid is in the extremely high temperature range V, the hydraulic fluid in the high temperature state can be prevented from flowing to wear and damage the hydraulic devices or fluid passages.

In the present example embodiment, the electric working machine 1 includes a cooler (oil cooler) 37 to cool the hydraulic fluid, and the controller 7 is configured or programmed to: when the temperature T of the hydraulic fluid detected by the fluid temperature detector 44 is higher than the allowable temperature range III, drive the cooler 37 to cool the hydraulic fluid, and when the temperature T of the hydraulic fluid is lower than or equal to the allowable temperature range III, stop the cooler 37. Accordingly, when the temperature T of the hydraulic fluid is high, if the at least one switch 5*c* or 58 is switched to the second position, or the at least one working device 20 or 10 is not actuated for a predetermined time or longer, by rotating the electric motor 9 at the second rotation speed R2, which is low, wasteful electric power consumption can be reduced, and by using the cooler 37 in combination, the time taken to cool the hydraulic fluid to the allowable temperature range III can be shortened. In addition, when the temperature T of the hydraulic fluid is low, by stopping the cooler 37, wasteful electric power consumption can be reduced, and by rotating the electric motor 9 to circulate the hydraulic fluid, the hydraulic fluid can be warmed up.

In the present example embodiment, the electric working machine 1 includes an inverter 38 to adjust the electric power supplied from the battery 30 to the electric motor 9, a rotation speed detector 42 to detect the rotation speed R of the electric motor 9, and at least one work operation interface 5*a* or 5*b* (for example, work operation lever 5*a* or travel operation lever 5*b*) to operate the actuation of the at least one working device 20 or 10, the at least one switch 5*c* or 58 includes an unload operation interface 5*c* switchable between a load position to permit the actuation of the at least one working device 20 or 10 and an unload position to not permit the actuation of the at least one working device 20 or 10, and the controller 7 is configured or programmed to control the rotation speed R of the electric motor 9 by adjusting the electric power supplied from the inverter 38 to the electric motor 9, based on the rotation speed R of the electric motor 9 detected by the rotation speed detector 42.

From the above, by switching the unload operation interface 5*c* to either the load position or the unload position, the actuation of the at least one working device 20 or 10 can be permitted or not permitted. In addition, the rotation speed R of the electric motor 9 can be reliably set to the specified value by the specifier 5*d* or one of the predetermined rotation speeds R1 to R3. In addition, the AI-SW 45 can detect whether the at least one work operation interface 5*a* or 5*b* is operated, which corresponds to whether the at least one working device 20 or 10 are actuated. Furthermore, by controlling the rotation speed R of the electric motor 9 to the first rotation speed R1 in a state in which the electric power supply from the battery 30 to the electric motor 9 by the inverter 38 is continued, electric power consumption can be reduced when subsequently increasing the rotation speed R of the electric motor 9 compared with when the electric power supply from the battery 30 to the electric motor 9 is interrupted, and also, the responsiveness of the electric motor 9 can be improved.

The above example embodiments have described an example in which the present invention is applied to the electric working machine 1 such as a backhoe. However, the application target of example embodiments of the present invention is not limited to this, and the present invention may be applied to other construction machines such as a wheel loader, a compact track loader, and a skid-steer loader and may be applied to agricultural machines such as a tractor, a combine, a rice transplanter, and a lawn mower.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electric working machine comprising:

a machine body;

a battery mounted on the machine body;

an electric motor to be driven by electric power from the battery;

a hydraulic device to be actuated by power from the electric motor;

a working device to be actuated by a hydraulic pressure of a hydraulic fluid supplied from the hydraulic device;

a controller configured or programmed to control driving of the electric motor;

a switch operable to be switched between a first position to permit actuation of the working device and a second position to not permit the actuation of the working device; and a fluid temperature detector to detect a temperature of the hydraulic fluid; wherein the controller is configured or programmed to:

while the electric motor is being driven, when the switch is switched to the second position and the temperature of the hydraulic fluid is within a predetermined allowable temperature range that is neither in a low temperature state nor a high temperature state, control a rotation speed of the electric motor to a predetermined first rotation speed corresponding to a stopped state of the electric motor; and while the electric motor is being driven, when the switch is switched to the second position and the temperature of the hydraulic fluid is not within the allowable temperature range, control the rotation speed of the electric motor to a predetermined idling rotation speed higher than the first rotation speed and lower than or equal to a lower limit of the rotation speed when the working device performs work.

2. The electric working machine according to claim 1, wherein while the electric motor is being driven, when the switch is switched to the second position, the controller is configured or programmed to:

if the temperature of the hydraulic fluid is lower than the allowable temperature range, control the rotation speed of the electric motor to coincide with a predetermined third rotation speed; and if the temperature of the hydraulic fluid is higher than the allowable temperature range, control the rotation speed of the electric motor to a predetermined second rotation speed higher than the first rotation speed and lower than the third rotation speed.

3. The electric working machine according to claim 2, further comprising a work detector to be actuated by the hydraulic pressure of the hydraulic fluid so as to detect whether the working device is actuated; wherein the second rotation speed is set to a rotation speed such as to cause the hydraulic fluid to have a hydraulic pressure that enables the work detector to detect whether the working device is actuated.

4. The electric working machine according to claim 3, wherein while the electric motor is being driven, when the switch is in the first position and the working device is not actuated for a predetermined time or longer, the controller is configured or programmed to:

if the temperature of the hydraulic fluid is lower than the allowable temperature range, control the rotation speed of the electric motor to coincide with the third rotation speed; and if the temperature of the hydraulic fluid is higher than or equal to a lower limit of the allowable temperature range, control the rotation speed of the electric motor to the second rotation speed.

5. The electric working machine according to claim 1, further comprising:

a specifier to be operated to specify the rotation speed of the electric motor; wherein the controller is configured or programmed to set, according to the temperature of the hydraulic fluid, the rotation speed of the electric motor specifiable by operation of the specifier.

6. The electric working machine according to claim 5, further comprising a selector to select either a first mode or a second mode that reduces electric power consumption more than the first mode; wherein the controller is configured or programmed to, when the temperature of the hydraulic fluid is within the predetermined allowable temperature range, set an upper limit of a specified range for the rotation speed of the electric motor by operation of the specifier when the second mode is selected by the selector to be smaller than the upper limit of the specified range when the first mode is selected by the selector.

7. The electric working machine according to claim 6, wherein the controller is configured or programmed to, when the temperature of the hydraulic fluid is lower than a predetermined first temperature lower than the predetermined allowable temperature range, regardless of whether the first mode or the second mode is selected by the selector, set the upper limit of the specified range for the rotation speed of the electric motor by operation of the specifier to a value smaller than a predetermined maximum rotation speed; and the predetermined maximum rotation speed is an upper limit of the rotation speed specifiable by the specifier when the temperature of the hydraulic fluid is within the predetermined allowable temperature range and the first mode is selected.

8. The electric working machine according to claim 6, wherein the controller is configured or programmed to, when the temperature of the hydraulic fluid is higher than a predetermined second temperature higher than the predetermined allowable temperature range, regardless of whether the first mode or the second mode is selected by the selector, set the rotation speed specifiable by the specifier to a third rotation speed.

9. The electric working machine according to claim 1, further comprising a cooler to cool the hydraulic fluid; wherein the controller is configured or programmed to:

when the temperature of the hydraulic fluid detected by the fluid temperature detector is higher than the predetermined allowable temperature range, drive the cooler to cool the hydraulic fluid, and when the temperature of the hydraulic fluid is lower than or equal to the predetermined allowable temperature range, stop the cooler.

10. The electric working machine according to claim 1, further comprising:

an inverter to adjust the electric power supplied from the battery to the electric motor;

a rotation speed detector to detect the rotation speed of the electric motor; and a work operation interface to operate the actuation of the working device; wherein the switch includes an unload operation interface switchable between a load position to permit the actuation of the working device and an unload position to not permit the actuation of the working device, and the controller is configured or programmed to control the rotation speed of the electric motor by adjusting the electric power supplied from the inverter to the electric motor, based on the rotation speed of the electric motor detected by the rotation speed detector.

11. An electric working machine comprising:

a machine body;

a battery mounted on the machine body;

an electric motor to be driven by electric power from the battery;

a hydraulic device to be actuated by power from the electric motor;

a working device to be actuated by a hydraulic pressure of a hydraulic fluid supplied from the hydraulic device;

a controller configured or programmed to control driving of the electric motor;

a switch operable to be switched between a first position to permit actuation of the working device and a second position to not permit the actuation of the working device; and a fluid temperature detector to detect a temperature of the hydraulic fluid; wherein when the switch is in the first position and the working device has not been actuated for a predetermined time or longer, the controller is configured or programmed to:

if the temperature of the hydraulic fluid is lower than a predetermined allowable temperature range, control a rotational speed of the electric motor to coincide with a predetermined third rotational speed higher than a predetermined first rotational speed corresponding to a stopped state of the electric motor and lower than or equal to a lower limit of a rotational speed when the working device performs work; and if the temperature of the hydraulic fluid is higher than or equal to a lower limit of the predetermined allowable temperature range, control the rotational speed of the electric motor to a predetermined second rotational speed higher than the first rotational speed and lower than the third rotational speed.

12. The electric working machine according to claim 11, further comprising:

a specifier to be operated to specify the rotation speed of the electric motor; wherein the controller is configured or programmed to set, according to the temperature of the hydraulic fluid, the rotation speed of the electric motor specifiable by operation of the specifier.

13. The electric working machine according to claim 12, further comprising a selector to select either a first mode or a second mode that reduces electric power consumption more than the first mode; wherein the controller is configured or programmed to, when the temperature of the hydraulic fluid is within the predetermined allowable temperature range, set an upper limit of a specified range for the rotation speed of the electric motor by operation of the specifier when the second mode is selected by the selector to be smaller than the upper limit of the specified range when the first mode is selected by the selector.

14. The electric working machine according to claim 13, wherein the controller is configured or programmed to, when the temperature of the hydraulic fluid is lower than a predetermined first temperature lower than the predetermined allowable temperature range, regardless of whether the first mode or the second mode is selected by the selector, set the upper limit of the specified range for the rotation speed of the electric motor by operation of the specifier to a value smaller than a predetermined maximum rotation speed; and the predetermined maximum rotation speed is an upper limit of the rotation speed specifiable by the specifier when the temperature of the hydraulic fluid is within the predetermined allowable temperature range and the first mode is selected.

15. The electric working machine according to claim 13, wherein the controller is configured or programmed to, when the temperature of the hydraulic fluid is higher than a predetermined second temperature higher than the predetermined allowable temperature range, regardless of whether the first mode or the second mode is selected by the selector, set the rotation speed specifiable by the specifier to a third rotation speed.

16. The electric working machine according to claim 11, further comprising a cooler to cool the hydraulic fluid; wherein the controller is configured or programmed to:

when the temperature of the hydraulic fluid detected by the fluid temperature detector is higher than the predetermined allowable temperature range, drive the cooler to cool the hydraulic fluid; and when the temperature of the hydraulic fluid is lower than or equal to the predetermined allowable temperature range, stop the cooler.

17. The electric working machine according to claim 11, further comprising:

an inverter to adjust the electric power supplied from the battery to the electric motor;

a rotation speed detector to detect the rotation speed of the electric motor; and a work operation interface to operate the actuation of the working device; wherein the switch includes an unload operation interface switchable between a load position to permit the actuation of the working device and an unload position to not permit the actuation of the working device; and the controller is configured or programmed to control the rotation speed of the electric motor by adjusting the electric power supplied from the inverter to the electric motor, based on the rotation speed of the electric motor detected by the rotation speed detector.

* * * * *